United States Patent [19]

Hazelett et al.

[11] 4,150,711

[45] Apr. 24, 1979

[54] METHOD AND APPARATUS FOR CONTINUOUSLY CASTING METAL SLAB, STRIP OR BAR WITH PARTIAL THICKNESS INTEGRAL LUGS PROJECTING THEREFROM

[75] Inventors: Robert W. Hazelett, Winooski; John F. B. Wood, Burlington, both of Vt.

[73] Assignee: Hazelett Strip-Casting Corporation, Winooski, Vt.

[21] Appl. No.: 838,079

[22] Filed: Sep. 30, 1977

[51] Int. Cl.[2] ..... B22D 11/06; B22D 11/16

[52] U.S. Cl. ..... 164/87; 164/154; 164/431; 164/432

[58] Field of Search ..... 164/431, 4, 87, 429, 164/430, 432, 154; 204/288, 289; 429/186, 208

[56] References Cited

U.S. PATENT DOCUMENTS

| | | | |
|---|---|---|---|
| 1,503,070 | 7/1924 | Snyder | 429/186 X |
| 3,860,057 | 1/1975 | Garlick | 164/431 X |
| 3,937,274 | 2/1976 | Dompas | 164/432 |
| 3,955,615 | 5/1976 | Dompas et al. | 164/431 |

*Primary Examiner*—Othell M. Simpson
*Assistant Examiner*—K. Y. Lin
*Attorney, Agent, or Firm*—Parmelee, Johnson, Bollinger & Bramblett

[57] ABSTRACT

Method and apparatus are described for continuously casting metal slab, strip or bar with integral lugs projecting therefrom. These lugs project from the edge of the cast product and lie in the casting plane, but they have a partial thickness as compared with the thickness of the product. Continuous wide slabs of unrefined copper or other electrolytically refinable metal having partial thickness lugs on both edges can be cut to form electrode plates for subsequent refining by suspending in an electrolytic bath. These partial thickness lugs serve as supports and provide electrical connection from the side rails of the electrolytic cell. Their partial thickness conserves metal and weight. In the continuous casting method and apparatus the revolving edge dams include special dam blocks defining partial thickness mold pockets for casting the integral lugs. Synchronization of lug positions along opposite edges of the cast product is maintained by controllably changing the relative temperatures of the revolving edge dams with respect to each other, for example, by relatively increasing the cooling of one of the revolving edge dams when it tends to lag the other, thereby relatively decreasing its length and increasing its rate of revolving, or, for example, by relatively decreasing the cooling of one when it tends to lead the other, thereby relatively increasing its length and decreasing its rate of revolving.

44 Claims, 29 Drawing Figures

30 OR 30A
70'
72'
74
62
182
180
186
188
22
43
44
45
56
C
54
52
48
49
24
47

METHOD AND APPARATUS FOR CONTINUOUSLY CASTING METAL SLAB, STRIP OR BAR WITH PARTIAL THICKNESS INTEGRAL LUGS PROJECTING THEREFROM

BACKGROUND OF THE INVENTION

It has been proposed, for example, in U.S. Pat. No. 3,860,057, issued Jan. 14, 1975, to T. W. Garlick, to manufacture a strip of anodes using continuous casting apparatus including upper and lower flexible belts having movable edge dams disposed between them and moving therewith at substantially the same speed. The edge dams are formed by a series of blocks which provide spaced recesses extending the full depth of the edge dams to permit the casting of integral lugs on the anodes.

One disadvantage of such an arrangement is that the continuous flexible metal strip on which the blocks are strung in end-to-end relationship is displaced away from the centerline of the respective edge dam toward the outer side of the blocks in a drastically offset position. This eccentrically located strip more tightly binds together the successive blocks along their outer sides as compared to their inner sides. The blocks along their inner sides are then bound together by a sequence of separate lengths of stranded flexible cable passing through longitudinal holes in the blocks intermediate the locations of their full depth recesses. Each such length of cable begins downstream from a full depth recess and ends upstream from the next successive full depth recess in the edge dam. The beginning and ending of each length of cable is anchored to respective blocks by means of socket set screws. Thus, the edge dams in a molten casting environment tend to exhibit more slack along their inner sides where the separate lengths of stranded cable are utilized as compared with their outer sides where the continuous metal strip is located. The operating result of these differences in slack along the inner and outer sides of each edge dam is illustrated in FIG. 1. The construction, handling and operation of such edge dam block assemblies is necessarily complicated and time consuming, and various operating problems can develop in a production environment due to their complexity.

It has also been proposed in that U.S. Pat. No. 3,860,057 to Garlick to synchronize the travel of the two edge dams by providing a rotatable shaft extending across the width of the casting machine at the input end of the machine and carried in a pair of suitable bearings near opposite sides of the machine. A pair of toothed wheels are secured to opposite ends of the shaft. The teeth of these wheels engage in synchronizing recesses in the blocks spaced along the outer sides of the respective edge dams.

A disadvantage of such an arrangement is that this rotatable shaft with its bearings and toothed wheels increases the complexity of the mechanism at the input of the machine and tends to constrict the room available for the apparatus which introduces the molten metal, thereby adding to the operating difficulties. Another disadvantage of such an arrangement is that whenever one of the edge dams is tending to lag or lead the other, the toothed wheels cause tugging and pulling on the respective dam blocks, shifting their relative positions, with the possibility of opening up spaces between successive blocks, which then provides an opportunity for flashing of molten metal into spaces between the blocks.

In U.S. Pat. No. 3,504,429, issued Apr. 7, 1970, to W.R.N. Snelgrove, it was proposed to manufacture anodes by continuously casting a plate of metal, cutting it into anode lengths, and subsequently using a press to form notches in each anode. Then the anodes were suspended by reusable hangers engaging in these notches.

A disadvantage of such an arrangement is that the hangers, once the anodes have been used, have to be returned to the casting apparatus for use with new anodes. This handling of the hangers and use of a press to form notches involves additional labor and machinery, with resultant expenses, and this procedural sequence increases the overall complexity of dealing with the anodes.

In U.S. Pat. No. 3,776,017, issued Dec. 4, 1973, to H. Ikeda, M. Yoneda and M. Ishii, a system for continuous manufacture of copper anodes is described in which a continuous strip of copper plate is cut into a series of generally T-shaped anodes. These T-shaped anodes extend transversely of the strips, and each successive anode as it is blanked out of the strip is reversed in position from its neighbor.

A disadvantage of this system is the need for a powerful blanking press for forming the anodes and associated equipment for diverging the severed anodes in different directions and for sorting and inspecting them. Also, the projecting lugs of the T-shaped anodes have the same thickness as the body of the anode.

SUMMARY OF THE INVENTION

According to one aspect of the present invention, a method of continuously casting a metal slab comprises the steps of forming a casting region by an endless revolving casting belt for supporting the molten metal and a pair of laterally spaced endless revolving edge dams travelling along either edge of the casting region with the casting belt at substantially the same speed as the belt, providing in each of said edge dams partial depth mold pockets communicating with the casting region and having a depth less than the depth of the casting region, and introducing molten metal into the casting region and cooling the metal therein to form a cast slab having integral partial thickness lugs extending from opposite edges thereof.

The partial depth mold pockets may extend laterally from the center of the casting region by a distance greater than the width of the remainder of edge dam itself. To accomplish such lateral extension of the partial depth mold pockets each of said edge dams may be provided by a multiplicity of damblocks of uniform width along the lower portions thereof, and said partial depth mold pockets in each edge dam may be extended laterally outwardly from the center of the casting region by a distance greater than such uniform width by providing special damblocks at spaced positions along the length of the edge dams. These special damblocks have upper portions projecting outwardly in cantilevered relationship with respect to their lower portions defining the partial depth mold pockets. Then the edge dams are guided along opposite sides of the casting region by guide means engaging said lower uniform width portions of the damblocks.

Each edge dam preferably is formed by a multiplicity of damblocks strung onto an endless strap loop. For example, according to one specific aspect of the present invention the endless strap loop extends in a groove through each damblock mid-way between the inner and outer sides of the edge dam for equalizing the slack of the edge dam along the inner and outer sides of the edge dam for holding the damblocks snuggly together, such groove extending longitudinally through each damblock near the bottom surface (or vice versa the top surface) of the edge dam, and partial depth mold pockets are formed in predetermined damblocks at spaced positions along the edge dams, such partial depth mold pockets being located in the top surface (or vice versa the bottom surface) of the edge dam, and the endless strap passes through such predetermined damblocks directly below (or vice versa directly above) the partial depth mold pocket therein for holding the damblocks snuggly together.

In order to provide partial thickness lugs on the anodes having the desired strength while at the same time providing clearance for the endless strap to pass through the predetermined damblocks containing the partial depth mold pockets, said strap passing directly below (or above) such mold pockets, the illustrative partial depth mold pockets described herein, have a depth of approximately 50% of the overall height of the edge dams.

It is among the many advantages of the method and apparatus employing the present invention that a strong continuous connection is provided for holding the multiplicity of damblocks snuggly together with equal effectiveness along the inner and outer sides of the edge dam.

According to another aspect of the present invention, the improved method of maintaining synchronization of the travel of the mold pockets of the respective edge dams along the opposite edges of the casting region comprises the steps of sensing the travel of the mold pockets of one edge dam relative to the other for determining whenever the one edge dam is tending to lag behind or to lead the other, and controllably changing the relative temperatures of the revolving edge dams, for example, by decreasing the relative temperature of the lagging one with respect to the other over at least a portion of its travel for relatively decreasing its length with respect to the other to speed up its rate of travel for overcoming its tendency to lag behind the other and vice versa whenever it tends to lead the other. The sensing of the travel of the mold pockets of one edge dam relative to the other may involve the sensing of the passage of predetermined damblocks of the edge dam past a predetermined point. Alternatively, this sensing of the travel of one edge dam relative to the other may comprise the sensing of the relative positions of the resultant cast lugs occurring on opposite edges of the continuous cast slab being formed.

According to a further aspect of the present invention, the improved method of maintaining synchronization of the travelling of the two edge dams for maintaining a predetermined relationship between the integral supporting shoulders being cast on opposite edges of the cast slab comprises the steps of sensing the relative positions of the laterally shouldered sections of the respective edge dams as they are each revolving, individually cooling each edge dam at a position along its return path of travel, and relatively increasing the cooling being applied to one of the edge dams with respect to the other whenever it tends to lag behind the other for relatively decreasing the length of such lagging edge dam thereby relatively increasing its rate of revolving with respect to the other edge dam for overcoming the lagging tendency for maintaining the travelling of two edge dams in synchronization.

The relative increase in the cooling of the lagging edge dam with respect to the leading one may be accomplished in accordance with one specific aspect of the present invention by decreasing the cooling being applied to the leading edge dam, thereby relatively increasing its length for decreasing its rate of revolving for overcoming its leading tendency.

According to a still further aspect of this invention apparatus for continuously casting a metal slab comprises at least one endless revolving flexible casting belt for supporting the molten metal in a casting region, and a pair of laterally spaced endless revolving edge dams travelling along at substantially the same speed as the belt define opposite edges of the casting region, each of said edge dams having a predetermined height, and each of said edge dams having a plurality of partial depth mold pockets therein at spaced positions therealong. These mold pockets communicate with the molten metal in the casting region and have a depth less than the predetermined height of the edge dam for casting a metal slab having integral partial thickness lugs extending from opposite edges thereof.

It is among the further advantages of the present invention in certain aspects that it provides improved travelling edge dams for continuously casting metal slab having partial thickness lugs thereon adapted for cutting into electrodes.

In accordance with a still further aspect of this invention there are provided special damblocks defining partial depth mold pockets which are advantageous and convenient for use in continuously casting electrodes.

It is among the further advantages of certain embodiments of the invention as described herein that the special damblocks enable partial thickness lugs to be integrally formed on the cast slab projecting laterally from the edge of the slab by a distance greater than the width of the remainder of the edge dam.

As used herein, the term "slab" is intended to be interpreted broadly to include a strip or a bar because this invention can be employed for continuously casting a strip or a bar (as well as a slab) having integral partial thickness lugs projecting from one side or from both sides thereof.

It is to be noted that each of FIGS. 15 through 28 are drawn on approximately the same scale which is approximately sixty percent of actual size.

Figure 4:
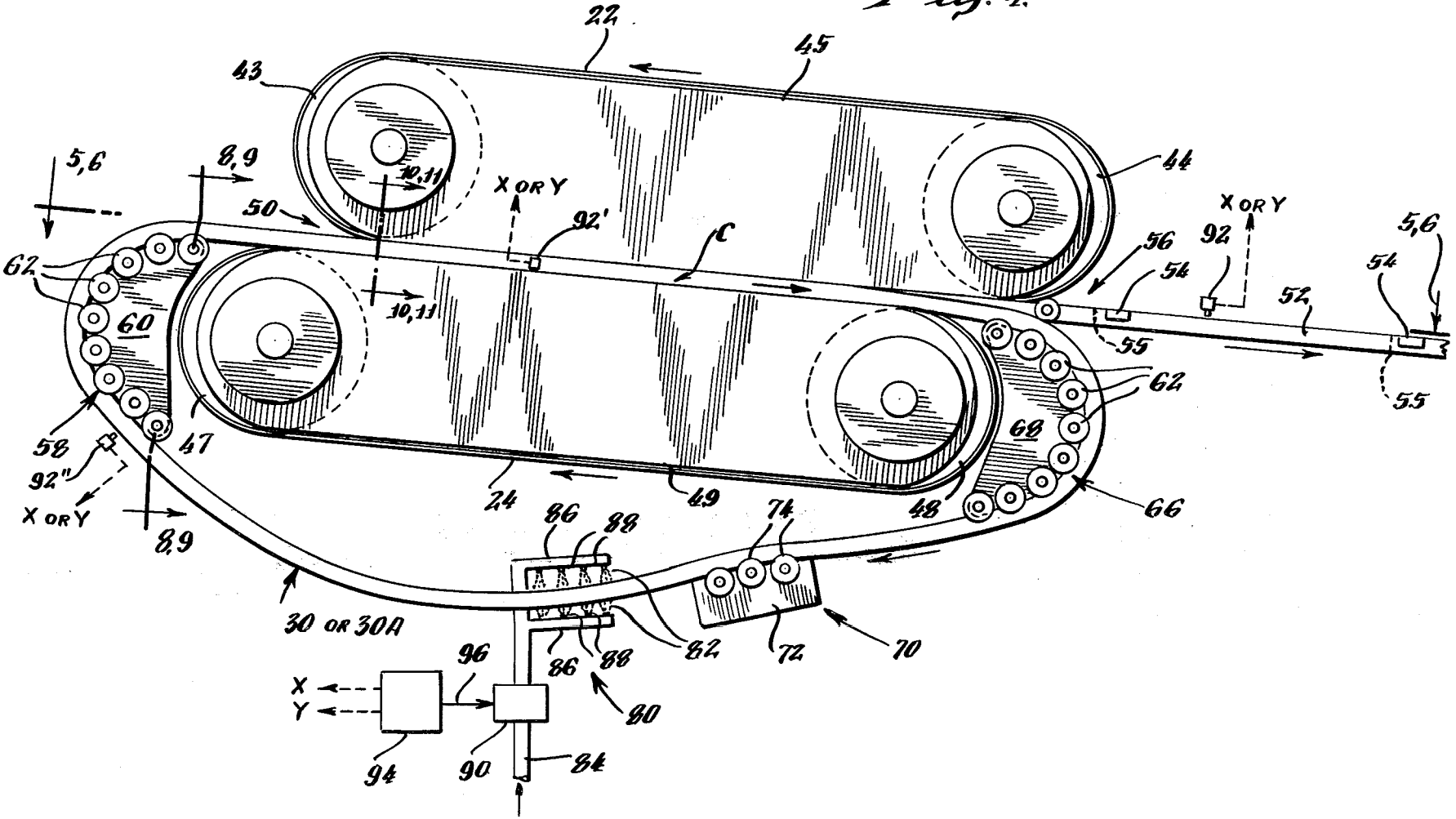
FIG. 4 is a side elevational view illustrating the casting method and apparatus of either FIGS. 2 or 3 continuously producing a metal slab having partial thickness lugs on the edge thereof.
Figure 17:
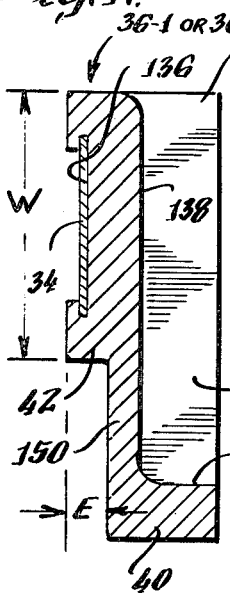
Figure 15:
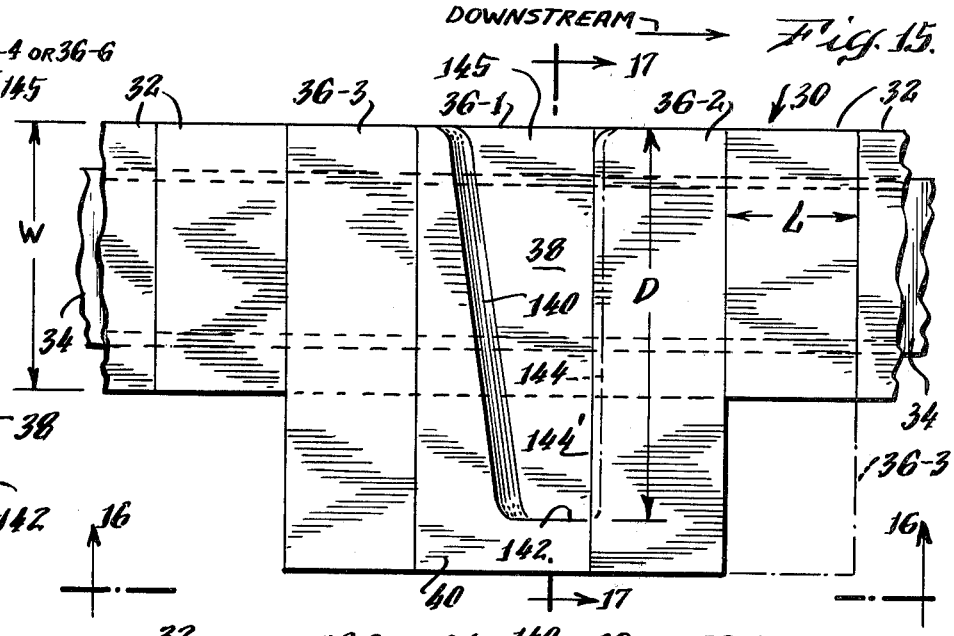
FIG. 15 is a plan view drawn on a scale which is approximately sixty percent of full size of a section of a travelling edge dam having a partial thickness lug mold pocket defined by the first system special damblocks.
Figure 16:
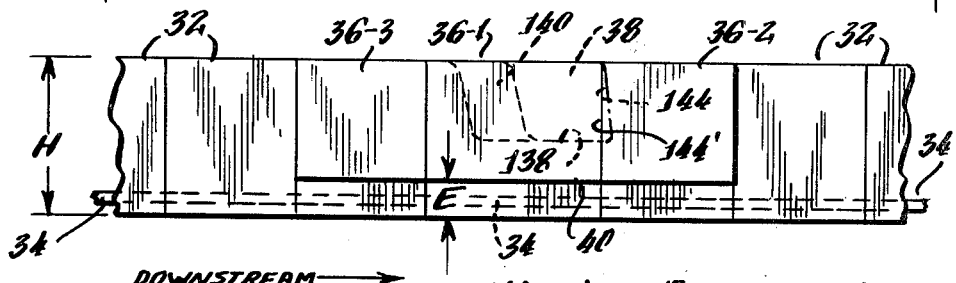
Figure 18:
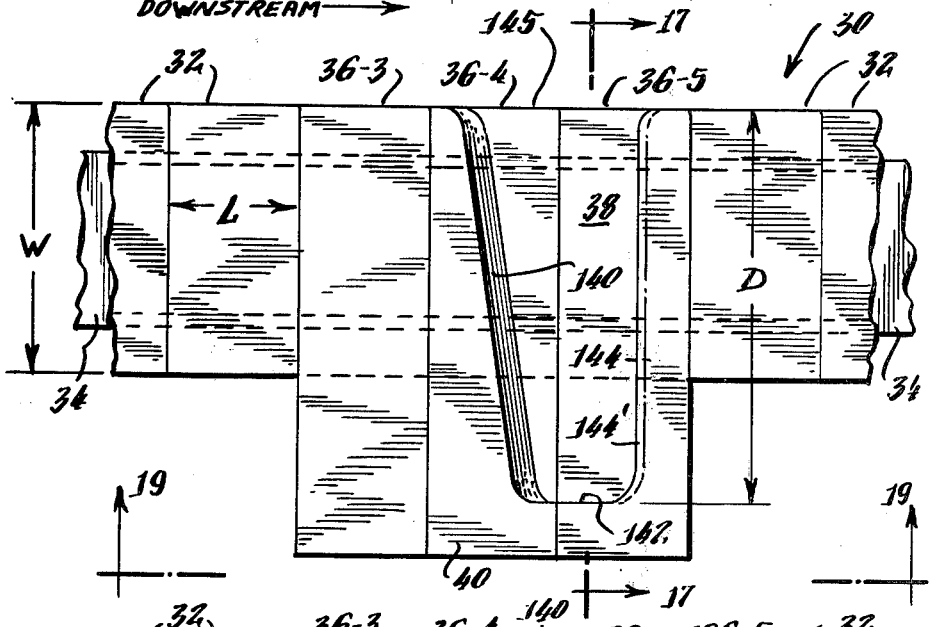
Figure 19:
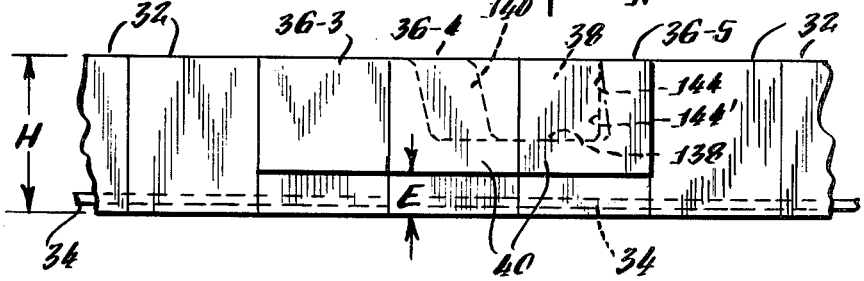
Figure 20:
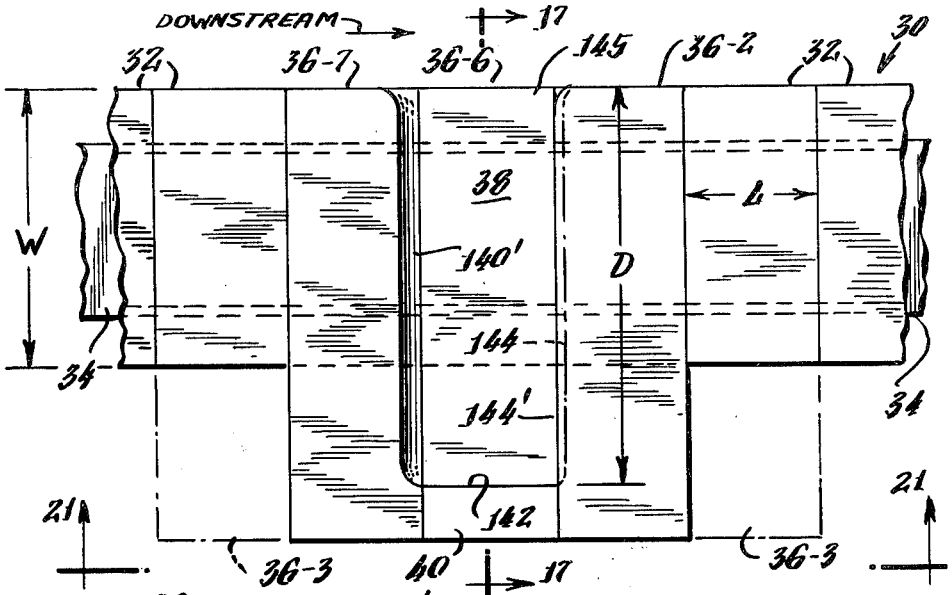
Figure 21:
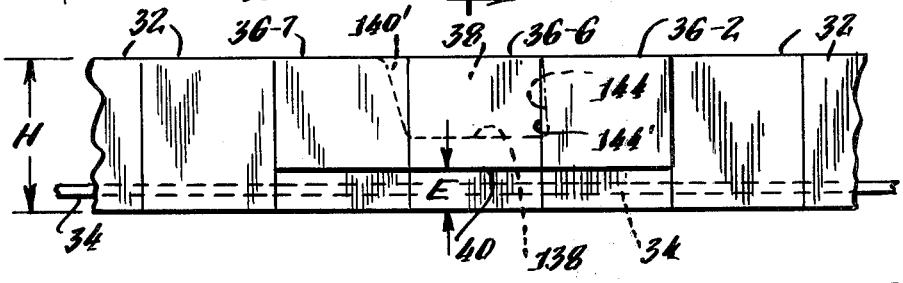
Figure 24:
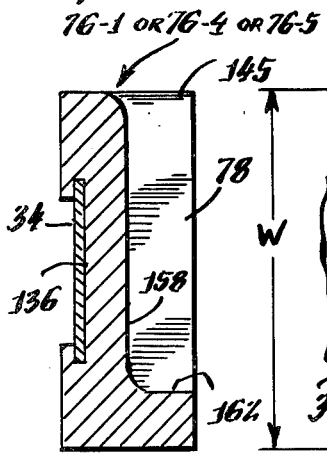
Figure 22:
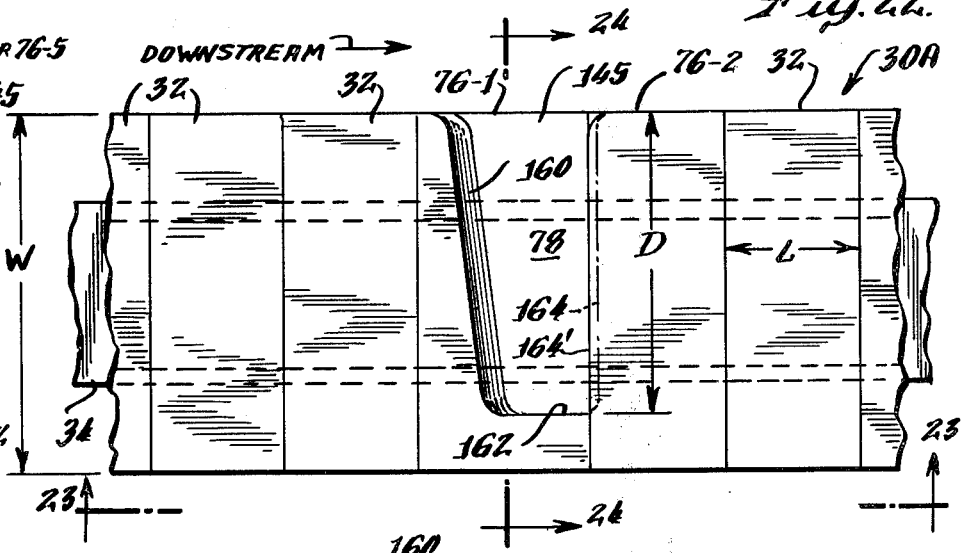
Figure 23:
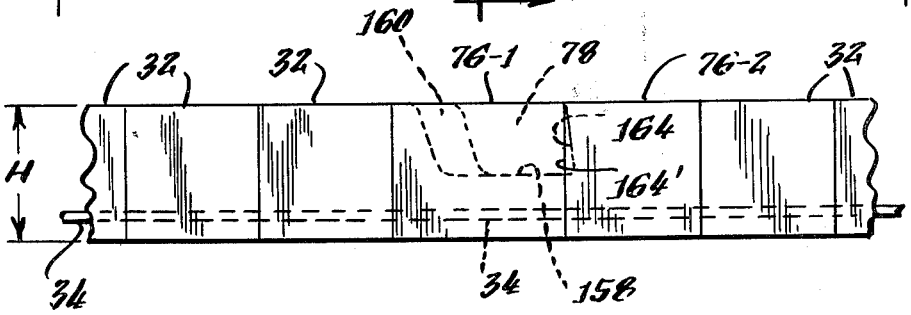
Figure 25:
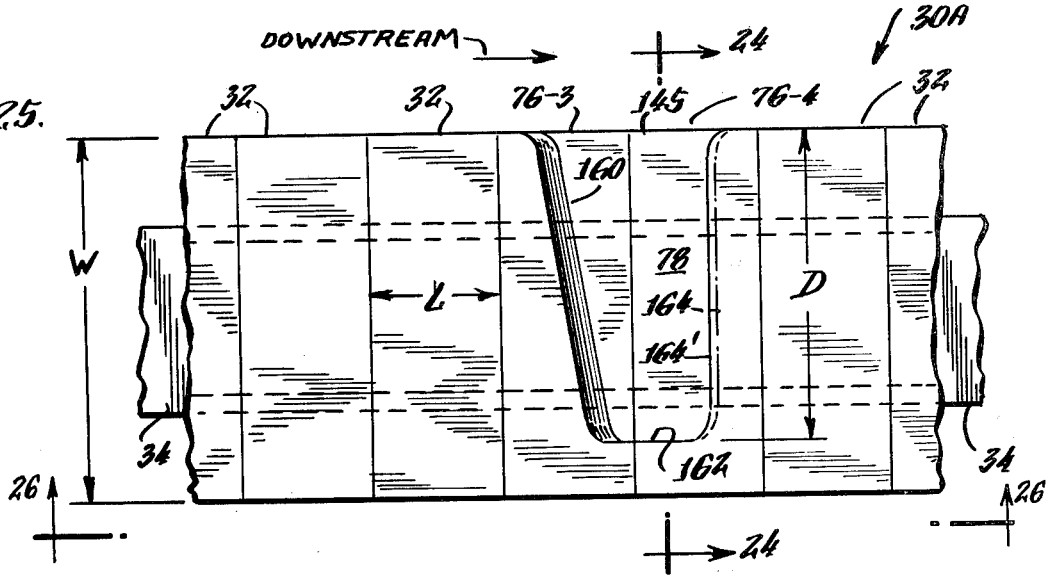
Figure 26:
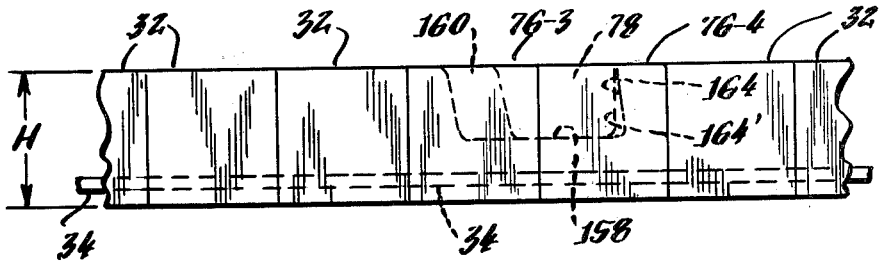
Figure 27:
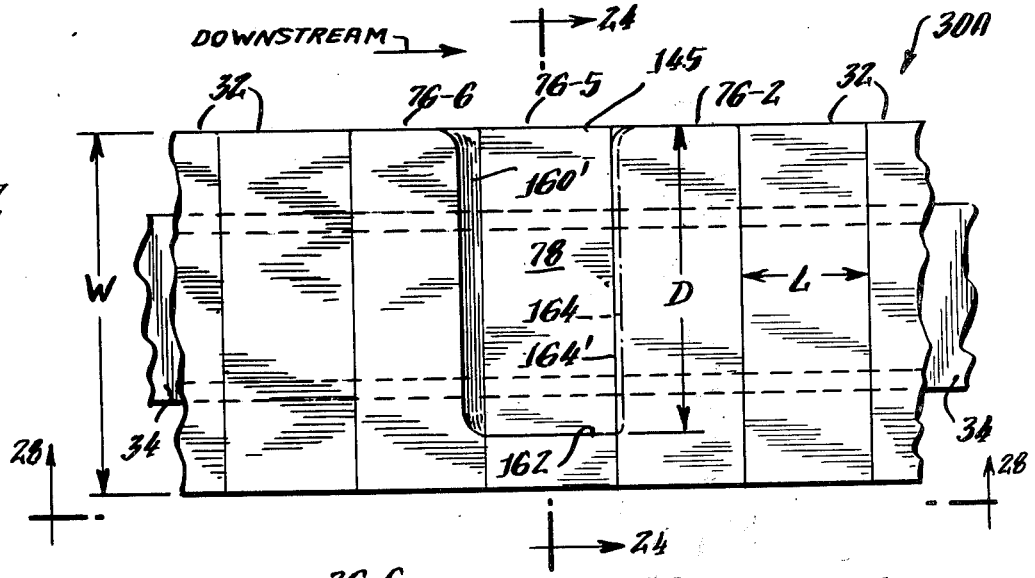
Figure 28:
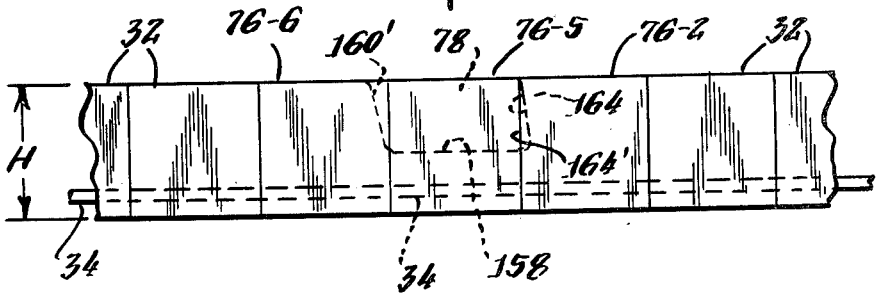
Figure 29:
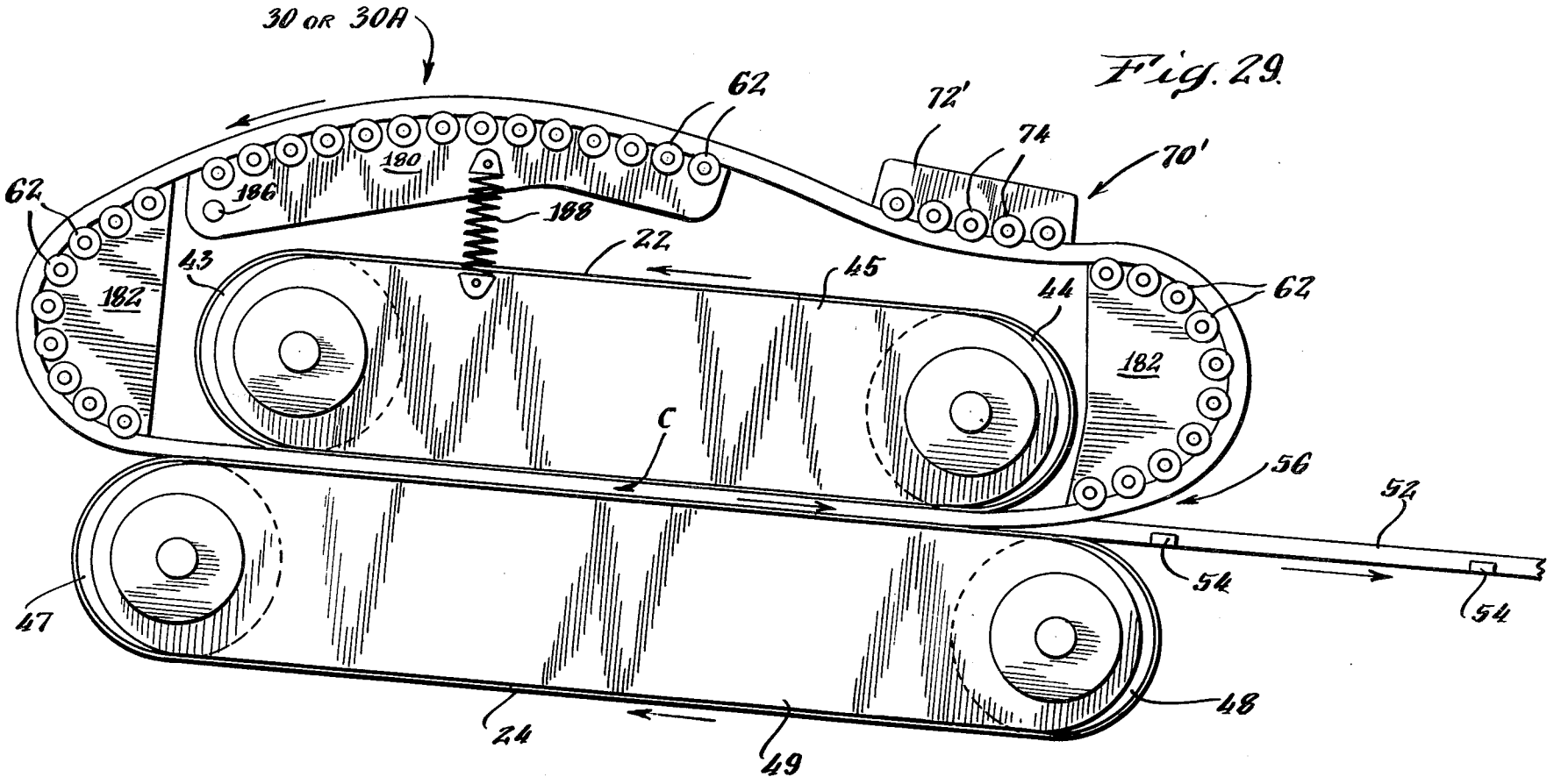

FIG. 16 is a side elevational view as seen along the line 16—16 in FIG. 15 looking toward the casting region;

FIG. 17 is a cross-sectional view taken along the line 17—17 in FIG. 15 or along the line 17—17 in FIG. 18, or along the line 17—17 in FIG. 20, as the case may be;

FIG. 18 is a plan view similar to FIG. 15 of a section of travelling edge dam incorporating a second embodiment of the first system special damblocks;

FIG. 19 is a side elevational view as seen in the direction 19—19 in FIG. 18 looking toward the casting region;

FIG. 20 is a plan view similar to FIGS. 15 and 18 of a section of travelling edge dam incorporating a third embodiment of the first system special damblocks;

FIG. 21 is a side elevational view as seen in the direction 21—21 in FIG. 20 looking toward the casting region;

FIG. 22 is a plan view of a section of a travelling edge dam having a partial thickness lug mold pocket defined by the second system special damblocks;

FIG. 23 is a side elevational view as seen in the direction 23—23 in FIG. 22 looking toward the casting region;

FIG. 24 is a cross-sectional view taken along the line 24—24 in FIG. 22, or along the line 24—24 in FIG. 25 or along the line 24—24 in FIG. 27, as the case may be;

FIG. 25 is a plan view similar to FIG. 22 of a section of travelling edge dam incorporating a second embodiment of the second system special damblocks;

FIG. 26 is a side elevational view taken in the direction 26—26 in FIG. 25 looking toward the casting region;

FIG. 27 is a plan view similar to FIGS. 22 and 25, showing a third embodiment of the second system special damblocks;

FIG. 28 is a side elevational view seen in the direction 28—28 in FIG. 27 looking toward the casting region; and FIG. 29 is a side elevational view similar to FIG. 4 illustrating the casting method and apparatus continuously producing a metal slab having partial thickness lugs on the edge, and in FIG. 29 the travelling edge dams encircle the upper casting belt.

In the various FIGURES corresponding reference numbers are used to indicate the same elements or those performing the same functions.

DETAILED DESCRIPTION

Figure 1:
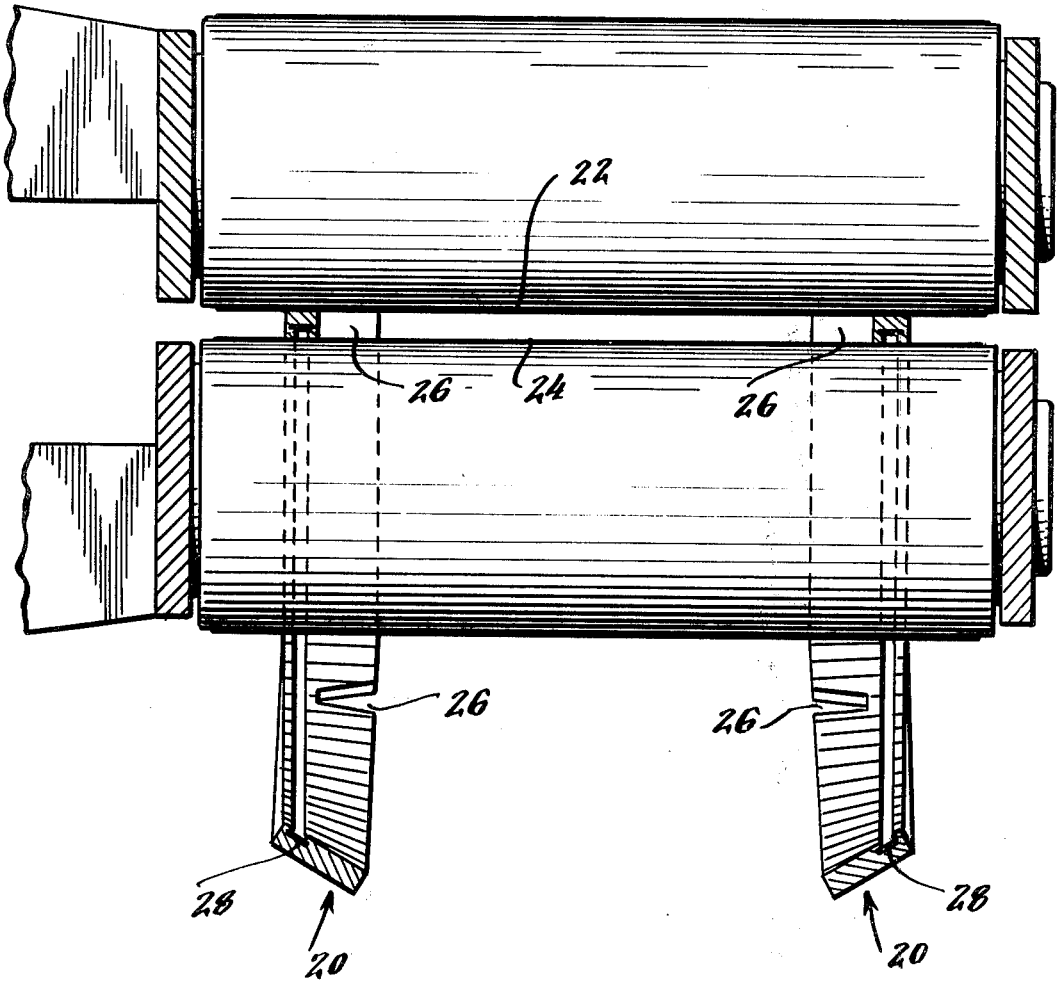
Fig. 1. PRIOR ART
FIG. 1 is an elevational sectional view taken through prior art continuous casting apparatus as seen looking in the downstream direction.

Referring to FIG. 1, the prior art edge dams 20 are disposed between upper and lower casting belts 22 and 24. These edge dams each revolve in a loop and contain full depth recesses 26 for casting full thickness lugs on anodes, as shown in U.S. Pat. No. 3,860,057. The relatively narrow continuous flexible metal strip 28 on which the blocks are strung in end-to-end relationship is displaced away from the centerline of the respective edge dam 20 toward the outer side thereof in a drastically offset position. This eccentrically located strip binds together the successive dam blocks of each edge dam more tightly along their outer sides, as compared to their inner sides. Although the damblocks along their inner sides are then bound together by a sequence of separate lengths of stranded flexible cable passing through longitudinal holes in the blocks intermediate the full depth recesses, such prior art edge dams in a molten metal casting environment tend to exhibit more slack along their inner sides as compared with their outer sides.

The operating result of these differentials in slack is illustrated in FIG. 1 where the inner sides of each edge dam are shown sagging farther down than their outer sides during the return travel of each edge dam. Thus, the edge dams become twisted and skewed during their return travel. Various operating problems can develop in a production environment due to the complexity of such prior art edge dams. The construction and handling of such prior art edge damblock assemblies is necessarily complicated and time consuming.

Figure 2:
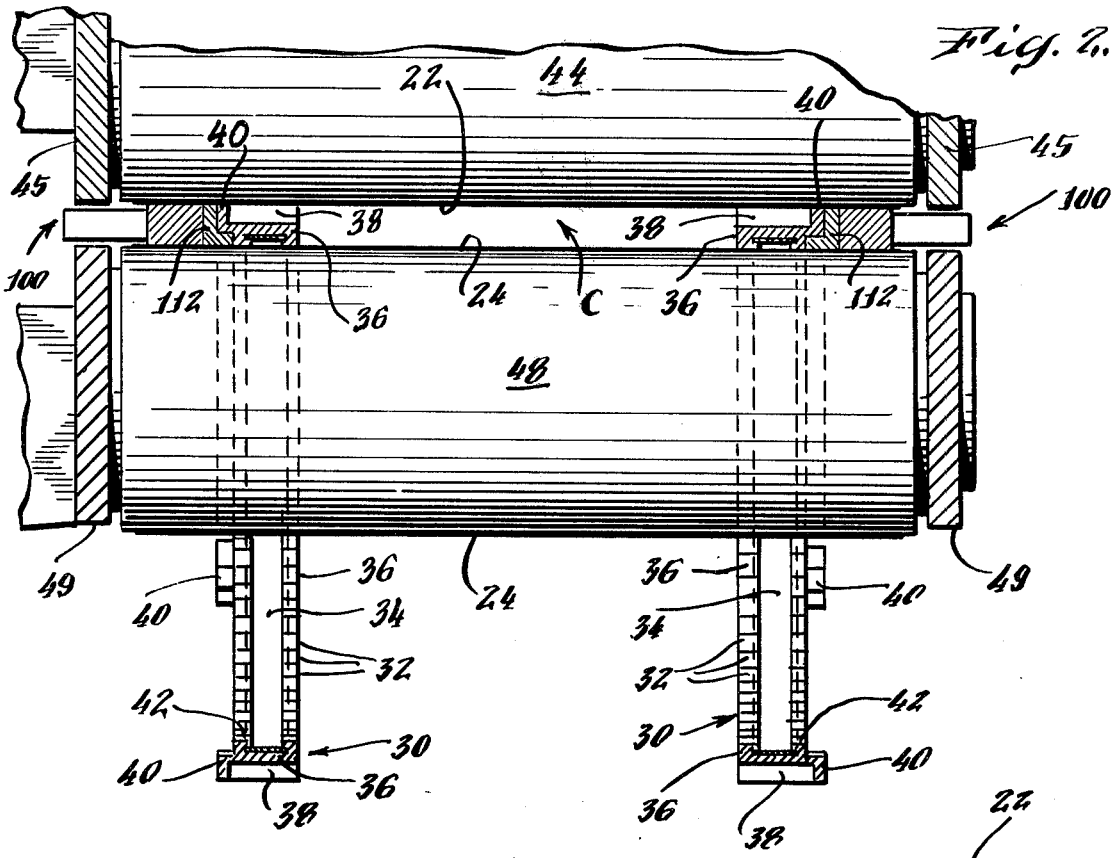
FIG. 2 is a partial elevational sectional view taken through continuous casting apparatus incorporating first system embodiments of the present invention as seen looking downstream. In the first system embodiments, the special damblocks for defining the partial depth mold pockets for casting the integral lugs are wider than the remaining regular damblocks comprising the travelling edge dams.
Figure 5:
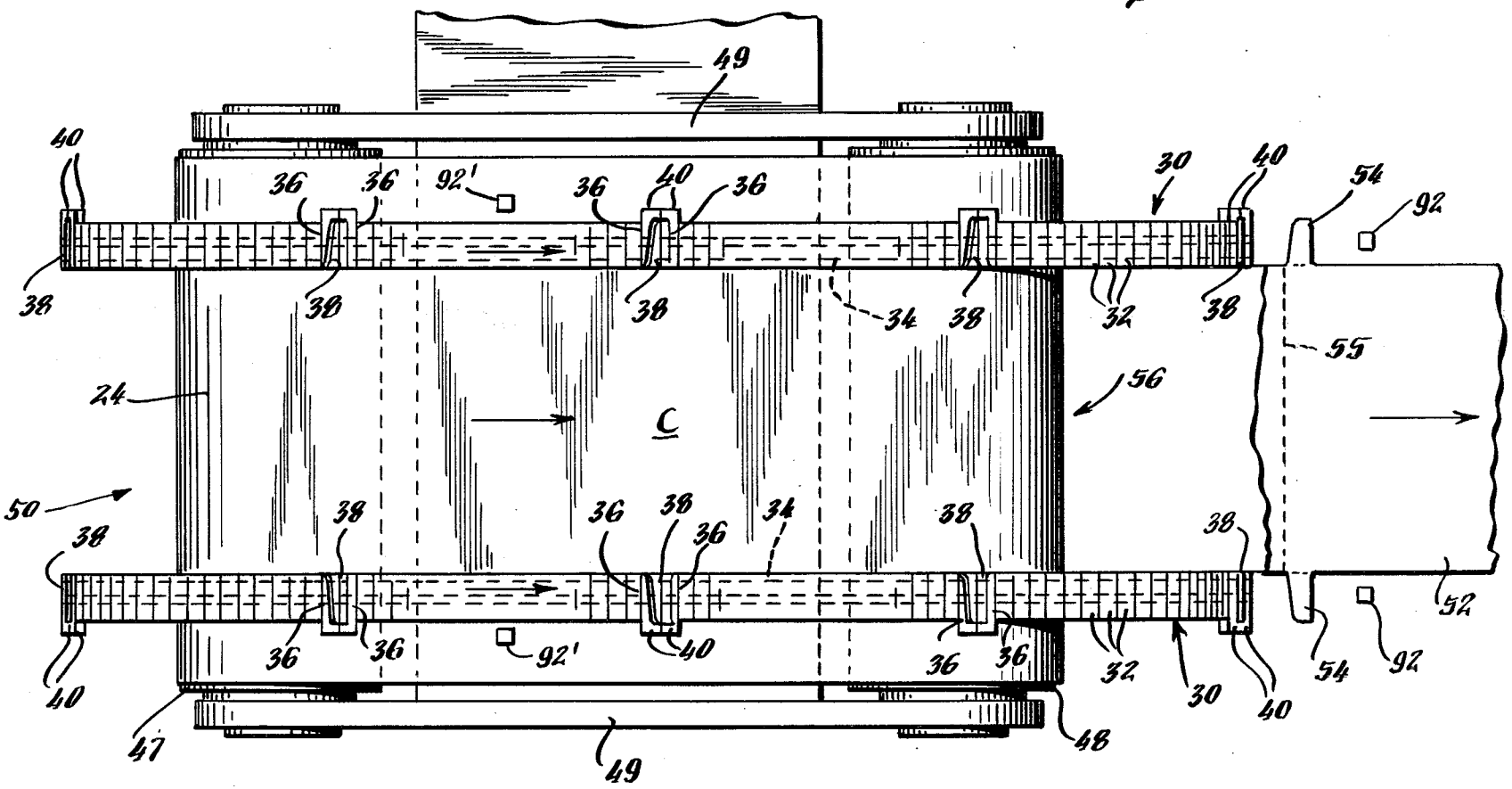
FIG. 5 is a plan view of the casting apparatus of FIG. 4 incorporating the first system wider special damblocks of FIG. 2, as seen looking down on the casting plane along the line 5—5 of FIG. 4.

In accordance with first system embodiments of the present invention as shown in FIGS. 2, 4 and 5, the travelling edge dams 30 comprise a multiplicity of damblocks 32 strung in end-to-end relationship onto an endless flexible metal strap 34 which is located along the centerline of the respective edge dam. This strap 34 is in the form of an endless loop, and it has a width preferably at least equal to half of the width of the edge dam itself. Thus, the damblocks in the edge dams 30 are bound together by the relatively wide and generally centrally located endless strap 34, producing approximately equal slack along the inner and outer sides of the edge dams. By virtue of this generally symmetrical arrangement of the metal strap 34, the edge dams 30 hang down with their damblocks horizontally positioned and travel along paths which are truly parallel, rather than being twisted and skewed as shown in FIG. 1.

At spaced positions along the length of each edge dam, there are special damblocks 36 defining partial depth mold pockets 38; that is, these mold pockets have a depth which is less than the height of the casting region C (FIG. 2) defined between the upper and lower casting belts 22 and 24. In this embodiment of the invention shown in FIG. 2, the partial depth mold pockets 38 extend laterally from the center of the casting region by a distance greater than the width of the regular damblocks 32. These wide width mold pockets 38 are defined by upper portions 40 of the special damblocks 36 which project out in cantilevered relationship with respect to their lower portions 42, which have the same width as the remaining regular damblocks 32.

Each of the partial depth mold pockets 38 may be defined by a single one of the special damblocks 36. Alternatively, these mold pockets 38 may be defined by a plurality of adjacent special damblocks 36. These various alternatives and detailed features of the partial depth mold pockets will be explained in greater detail further below.

Figure 3:
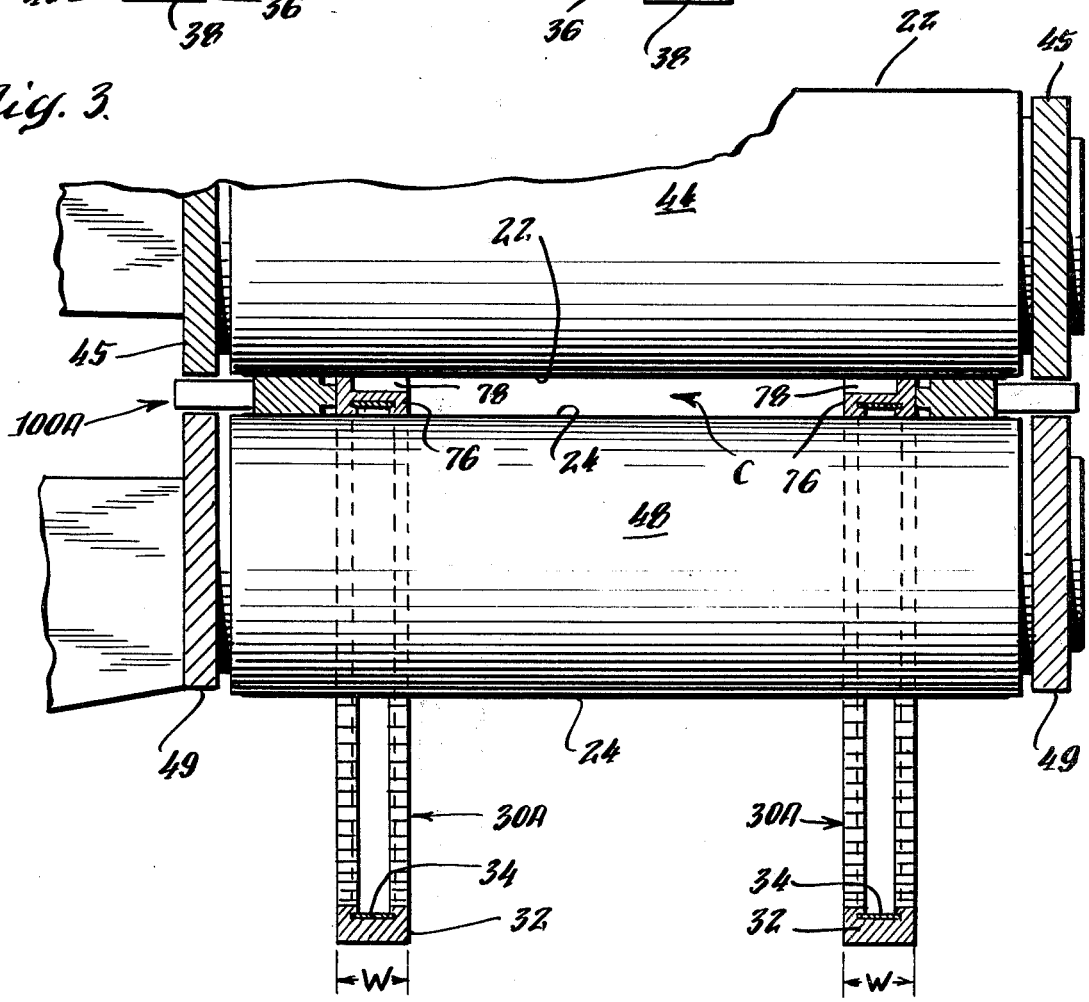
FIG. 3 is a partial elevational sectional view similar to FIG. 2 showing continuous casting apparatus incorporating second system embodiments of the present invention. In the second system embodiments, the special damblocks for defining the partial depth mold pockets are the same width as the remaining regular damblocks comprising the travelling edge dams.

In FIGS. 2 and 3 are shown the apparatus 100 and 100A for guiding the travelling edge dams 30 and 30A, respectively, along opposite edges of the casting region. This apparatus 100 and 100A is shown in greater detail in FIGS. 10 and 11 and will be explained later when discussing these Figures.

As shown in FIGS. 4 and 5, each edge dam 30 revolves in an elongated loop along a portion of which it is disposed between and travels with the casting belts 22 and 24 for defining the casting region C between them. The upper casting belt 22 is revolved around an upstream drive roll 43 and a downstream tensioning and steering roll 44 mounted on an upper frame 45. Similarly, the lower casting belt 24 is revolved around an upstream drive roll 47 and a downstream tensioning and steering roll 48 mounted on a lower frame 49. Molten metal is introduced into the input end 50 (FIGS. 4 and 5) of the casting region C and fills the casting region. This molten metal flows out into the partial depth mold pockets 38 which communicate with the casting region and form lateral extensions thereof. The metal is solidified as it is carried downstream between the casting belts, and a continuously cast slab 52 having partial thickness lugs 54 integrally formed on its opposite edges issues from the downstream end 56 of the casting region. It will be understood that the casting belts 22 and 24 are cooled along the casting region by liquid coolant applied as known to those skilled in the art, and cooling may also be directly applied to the slab 52 after it issues from the casting region.

Figure 6:
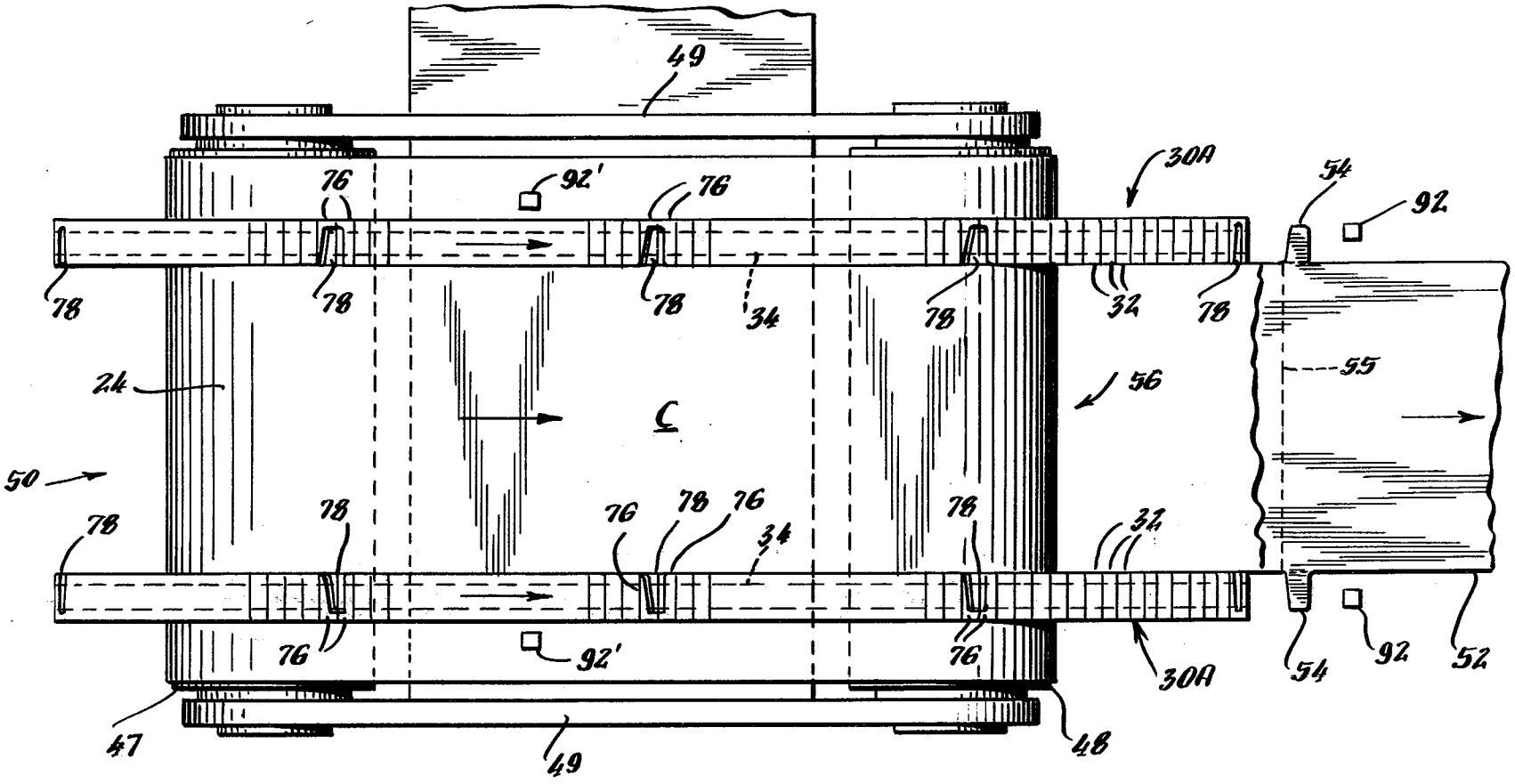
FIG. 6 is a plan view similar to FIG. 5 but showing the casting apparatus incorporating the second system special damblocks which are the same width as the regular damblocks.
Figure 12:
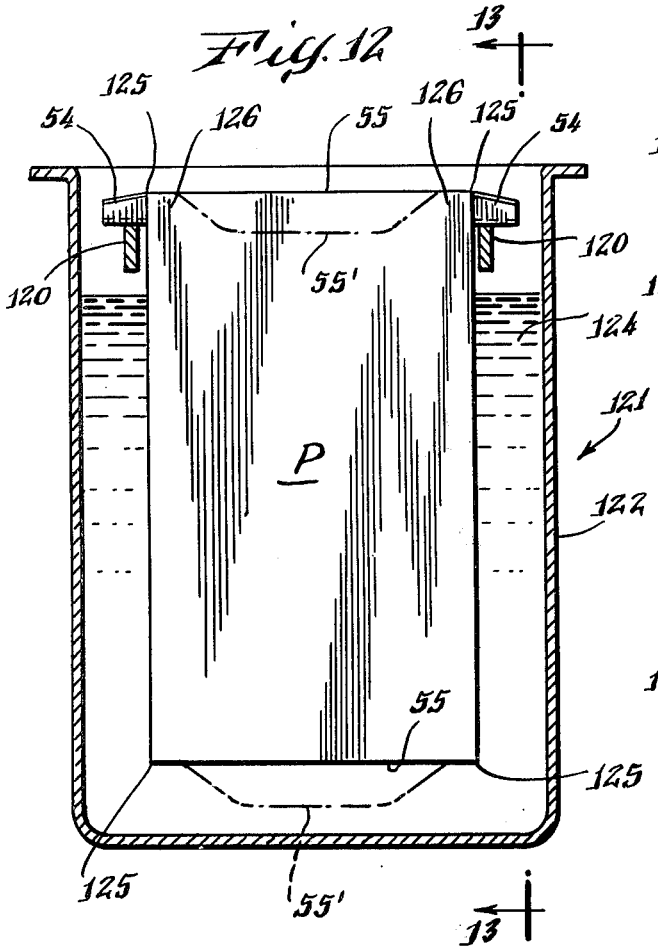
FIG. 12 is a cross-sectional view through an electrolytic cell taken along the plane 12—12 in FIG. 13 showing electrode plates having partial thickness lugs supported on the side rails of the cell.
Figure 13:
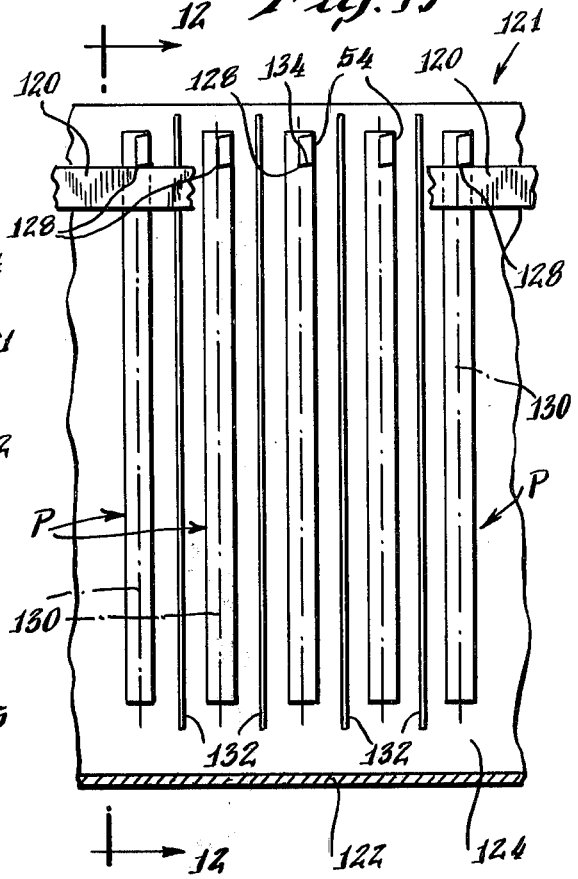
FIG. 13 is an elevational view of the cell of FIG. 12 taken along the line 13—13 in FIG. 12 showing a plurality of these electrodes in edge elevation in association with one of the side rails of the cell.
Figure 14:
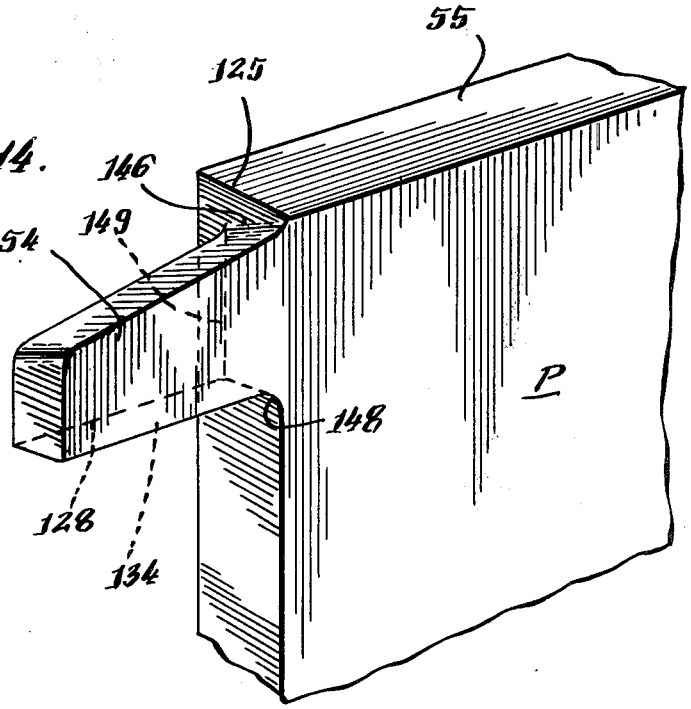
FIG. 14 is an enlarged perspective view showing a partial thickness lug projecting from the side edge of a portion of an electrode plate.

In order to form electrode plates, for example, such as copper anode plates, the slab 52 of copper is severed into separate plates by suitable cut off means (not shown). Such cut off means is preferably arranged to sever the slab 52 along transversely extending cut lines 55 which are located upstream from but near to the respective lugs 54. These lugs 54 are preferably located directly opposite each other as seen in FIGS. 5 and 6 on opposite edges of the slab, thereby forming a pair or support lugs for each resulting anode plate P (FIGS. 12, 13 and 14).

In approaching the input end 50 of the casting region, the edge dams 30 are guided by guide means generally indicated at 58 in FIG. 4. This edge dam guide means 58 includes a crescent-shaped support bracket 60 having a plurality of freely rotatable flanged rollers 62 mounted on stud bolts 63 at closely spaced positions along its convex perimeter (see FIG. 8).

Figure 8:
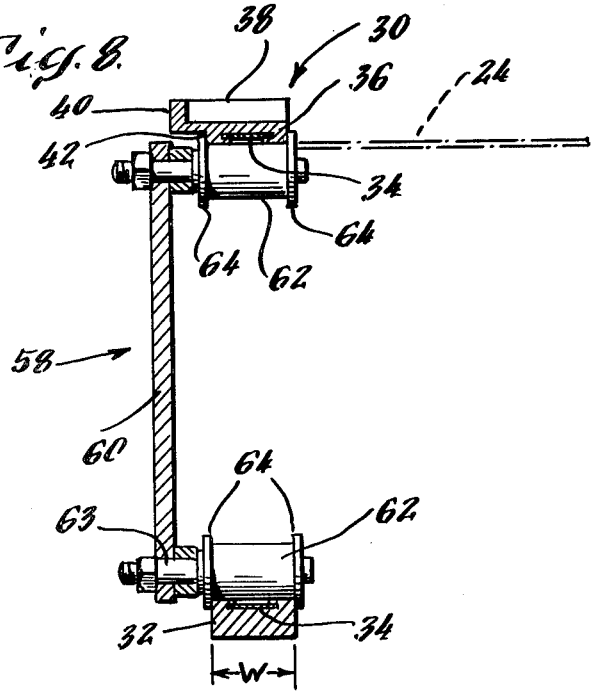
FIG. 8 is an enlarged cross-sectional view taken along the line 8—8 in FIG. 4 looking downstream and showing flanged guide rollers cooperating with one of the travelling edge dams containing the wider special damblocks.

As shown in FIG. 8, the flanges 64 on the rollers 62 with cylindrical barrels are spaced apart just far enough to straddle the width W of the regular damblocks 32. Thus, guidance is provided in the lateral direction to the edge dams 30. By virtue of the fact that the lower portions 42 of the special damblocks 36 have the same width as the regular damblocks 32, these portions 42 fit between the flanges 64 and engage in rolling contact with the cylindrical barrels of the rollers in the same manner as the other damblocks 32. Accordingly, the edge dams 30 are guided along their full length by the guide means 58 in spite of the fact that there are projecting cantilevered upper portions 40 on the special damblocks. These projecting portions 40 are elevated above the bottom of the special damblocks by a height sufficient to clear the flanges 64.

FIG. 8 shows the guide means 58 for the left edge dam 30, and it will be understood that similar guide means are provided for the other edge dam.

As shown in FIG. 4, similar guide means 66 are provided for each of the edge dams 30 after exit from the downstream end 56 of the casting region. The guide means 66 each includes a crescent-shaped support 68 with the flanged rollers 62 mounted at closely spaced positions along its perimeter.

The various embodiments of the present invention, as shown in FIGS. 2, 5 and 8, and also as described further below, in which there are projecting portions 40 of the special damblocks for defining partial depth mold pockets 38 extending laterally out beyond the width W of the regular damblocks are called herein "first system" embodiments.

Figure 9:
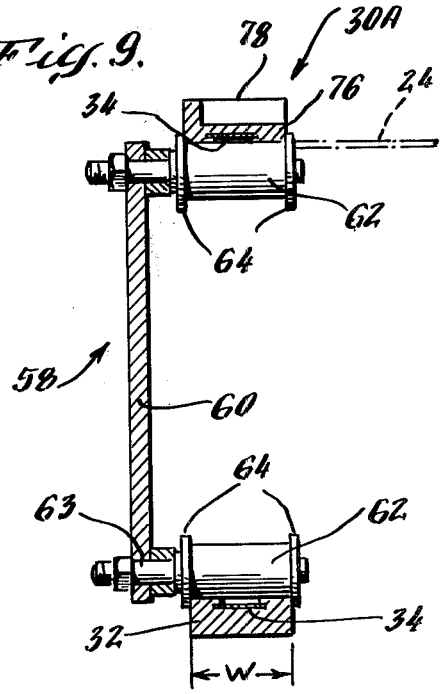
FIG. 9 is an enlarged cross-sectional view similar to FIG. 8, and taken along the line 9—9 in FIG. 4 looking downstream and showing flanged guide rollers cooperating with one of the edge dams containing the special second system damblocks which are the same width as the regular damblocks.

As shown in FIGS. 3, 6 and 9, and also as described further below, there are various embodiments of the invention called "second system" embodiments in which the partial depth mold pockets have a lateral extent which is less than the width W of the remaining damblocks.

Referring to FIGS. 3, 6 and 9, the edge dams 30A of the second system embodiments comprise a multiplicity of damblocks 32 strung onto an endless flexible metal strap 34 which is located along the centerline of the respective edge dam. This strap 34 preferably has a width at least equal to half of the width W of the regular damblocks 32. At spaced positions along each edge dam 30A there are special damblocks 76 defining partial depth mold pockets 78. These special damblocks 76 are the same width W as the regular damblocks 32.

The method of casting with the second system embodiments of the edge dams 30A is the same as described above, namely, the molten metal is introduced into the input end 50 (FIGS. 4 and 6) of the casting region C. The partial depth mold pockets 78 communicate with and form lateral extensions of the casting region. The molten metal flows laterally out into these mold pockets 78, and as it is carried downstream between the casting belts 22 and 24 it becomes solidified. A continuous slab 52 is cast having partial thickness lugs 54 integrally formed on its opposite edges.

In order to force the damblocks of the edge dams 30 or 30A tightly together along the casting region, so-called "back breaker" guide means 70 may be provided for each of the edge dams. This back-breaker guide means 70 engages the edge dam during a portion of its return path and causes the edge dams 30 or 30A to travel along a path segment which is convex toward the interior of its loop. The guide 70 includes a support 72 and a plurality of rollers 74 which have more widely spaced flanges than the rollers 62 for providing clearance for the projecting portions 40 (FIGS. 2, 5 and 8) of the special damblocks 36. In the case of the second system embodiments where the special damblocks 76 are the same width W as the regular damblocks 32, the rollers 74 may be similar to the rollers 62. For further information about the construction and operation of such a guide 70, the reader may refer to U.S. Pat. Nos. 3,865,176 and 3,955,615.

For cooling the edge dams 30 or 30A before their re-entry into the input end 50 of the casting region, cooling apparatus 80 is provided. This cooling apparatus is arranged for directing jets of fluid coolant 82 onto the edge dams 30 or 30A. The cooling apparatus 80 includes a supply line 84 for feeding the coolant fluid under pressure into conduits 86 having nozzles 88 for jetting the cooling fluid 82 onto the edge dams. This coolant fluid 82 may comprise cold air jetted at high velocity onto the edge dams 30 or 30A or liquid coolant sprayed thereon. Fluid flow control means 90, for example, such as a controllable valve, is interposed in the supply line 84 for regulating the amount of cooling being applied to the respective edge dams 30 or 30A, for reasons as will be explained below.

It is to be understood that the cooling apparatus 80 may be positioned at any convenient location along the path of return travel of the edge dam 30 or 30A. When the fluid coolant 82 is a liquid, for example, water is preferred, then the cooling apparatus 80 is positioned sufficiently far from the entry 50 to the casting region to provide for drying of each edge dam before it encounters the molten metal. The cooling apparatus 80 and the back-breaker guide means 70 may be reversed in location, so that the edge dam is cooled before passing the guide means 70. In cases where a flow 82 of cold air is used for cooling, this cooling may be applied at more than one location along the path of travel of the edge dam 30 or 30A.

Also, the back-breaker guide means 70 and the cooling apparatus 80 can be arranged in close association one with the other. For example, it is our preference at present that the back-breaker means 70 be separated longitudinally into two portions, and then the cooling apparatus 80, employing water as the coolant, is interposed between these two portions of the back-breaker. In this way, the back-breaker guides the edge dam both before and after its passing the cooling apparatus. Suitable enclosures and exhaust ducts may be provided to remove the water vapor generated, for example, as shown in U.S. Pat. Nos. 3,865,176 and 3,955,615, mentioned above.

It is noted that U.S. Pat. Nos. 3,865,176 and 3,955,615, mentioned above, do show the use of liquid spray cooling apparatus for cooling edge dams during their return travel, but they do not disclose nor suggest the present invention for maintaining synchronization of travel of the revolving edge dams.

In order to synchronize the travel of the partial depth mold pockets 38 or 78 along the opposite edges of the casting region during operation over an extended period of time, the travel of one edge dam relative to the other is sensed. This sensing of the edge dam travel may be accomplished in several ways. For example, as shown in FIGS. 4, 5 and 6, sensing means 92 may be positioned near opposite edges of the cast slab for responding to the passing of each of the lugs 54. Such sensing means may comprise a light source and photocell positioned such that the passing of each lug 54 changes the intensity of the light beam reaching the photocell. Alternatively, the sensing means 92 may comprise an electric switch with an actuator finger which is tripped by the passing of each lug 54. Other sensing means 92 for responding to the passing of such lugs 54 may be used.

Another way in which the sensing of the edge dam travel may be accomplished as shown in FIGS. 4, 5 and 6 is to locate the sensing means 92' or 92" at a predetermined position along the path of travel of each edge dam 30 or 30A. Such predetermined position may be near the edge of the casting region C or near the return travel path of the edge dam 30 or 30A. The sensing means 92' or 92" may be identical to the sensing means 92 for being responsive to passing of the projecting portions 40 of the special damblocks 36 in the first system embodiments of this invention in the same manner that the sensing means 92 is responsive to the passing of the projecting lugs 54.

Alternatively, the special damblocks 36 or 76 may include elements having different characteristics from the remaining regular damblocks 32, so that they may be distinguished by the sensing means 92' or 92". Such different characteristics may be optical, mechanical, electromagnetic, and so forth. For example, the outer ends of the special damblocks 36 or 76 may include inserts for triggering photocell or microwave response or notches for triggering the finger of an electric switch, and so forth. In effect, the special damblocks 36 or 76 may be appropriately marked or coded for cooperative interaction with the appropriate sensing means 92' or 92", as the coded damblocks pass by such sensing means.

In lieu of coding the special damblocks 36 or 76, predetermined ones of the regular damblocks may be coded, for example, such as every twentieth one thereof for triggering a response in the sensing means.

Regardless of the particular nature and location of the sensing means 92 or 92' or 92" and regardless of whether the lugs on the cast slab are being sensed or whether the passing of preselected damblocks past a predetermined point is being sensed, the result is that the relative rates of travel of the two edge dams may be sensed for determining whether either is tending to lag (or to lead) the other. The sensing means 92 or 92' or 92" for the respective left and right edge dams are connected by electrical leads X and Y to a controller 94 which automatically determines whether one of the edge dams is tending to lag (or lead) the other.

In order to maintain synchronization of the travel of the two revolving edge dams to synchronize travel of the partial depth mold pockets 38 or 78 along opposite edges of the casting region C, the controller 94 is connected by leads 96 to the fluid flow control means 90. Thus, the amount of cooling may be relatively increased (or vice versa decreased) to whichever of the edge dams happens to be tending to lag (or vice versa lead) at any given moment of operation.

The presently preferred method of achieving such synchronization of travel of the two edge dams is to preselect either the left or the right one as a standard or reference for comparison and then to control the rate of revolving of the other with respect to the reference one. When the sensing means 92, 92' or 92" show that the controlled edge dam is tending to lag or lead the reference one, then the temperature of the controlled edge dam is appropriately changed over at least a portion of its path of travel for overcoming the laggging or leading tendency.

The damblocks and the strap 34 which comprise each edge dam have a positive coefficient of temperature expansion. For example, the strap 34 is preferably formed of stainless steel material welded to form an endless loop and the damblocks may be formed of steel, aluminum or bronze. Consequently, relatively increasing the cooling being applied to one over at least a portion of its travel causes a relative slight decrease in its length relative to the other. This decrease in relative length produces an increase in its rate of revolving and consequently overcomes its tendency to lag.

Among the advantages of using a stainless steel strap 34 in the edge dams are those resulting from the fact that its coefficient of thermal expansion is very similar to that of bronze damblocks which are preferred for casting copper slab.

It is preferred, and is the best mode we know for putting this invention into practice, to make the cumulative length of the multiple damblocks comprising the two edge dams very nearly the same at room temperature and to make the length of the two endless flexible straps 34 very nearly the same at room temperature. Thus, the overall revolving travel of the two edge dams becomes nearly the same initially, thereby reducing the amount of corrective action called for by the synchronizing control during operation. Moreover, it is preferred and is the best mode we know to make the accumulated length of the damblocks between each successive partial depth mold pocket in each edge dam very nearly the same at room temperature. By the term "very nearly the same", we mean the advantageous results which can be obtained by reasonable, diligent and careful attention to the cumulative lengths involved; nothing heroic is needed.

In certain cases instead of increasing the effective cooling being applied to the lagging edge dam, the controller 94 may be arranged to decrease the effective cooling being applied to the leading edge dam. The overall result in either case is to compensate for any tendency toward disproportionate rates of travel of the controlled edge dam with respect to the reference edge dam. Consequently, it is to be understood that these various procedures for changing the temperature of one travelling edge dam with respect to the other over at least a portion of its path of travel are recognized in this specification and in the appended claims as being equivalent for the synchronizing purposes described herein. This edge dam synchronizing method and apparatus operates to advantage in casting projecting lugs on the slab because it keeps the damblocks in both edge dams snuggly abutting one against the other as they enter into the casting region and also as they travel along the casting region, thereby minimizing any tendency for flashing of molten metal between adjacent damblocks.

Figure 10:
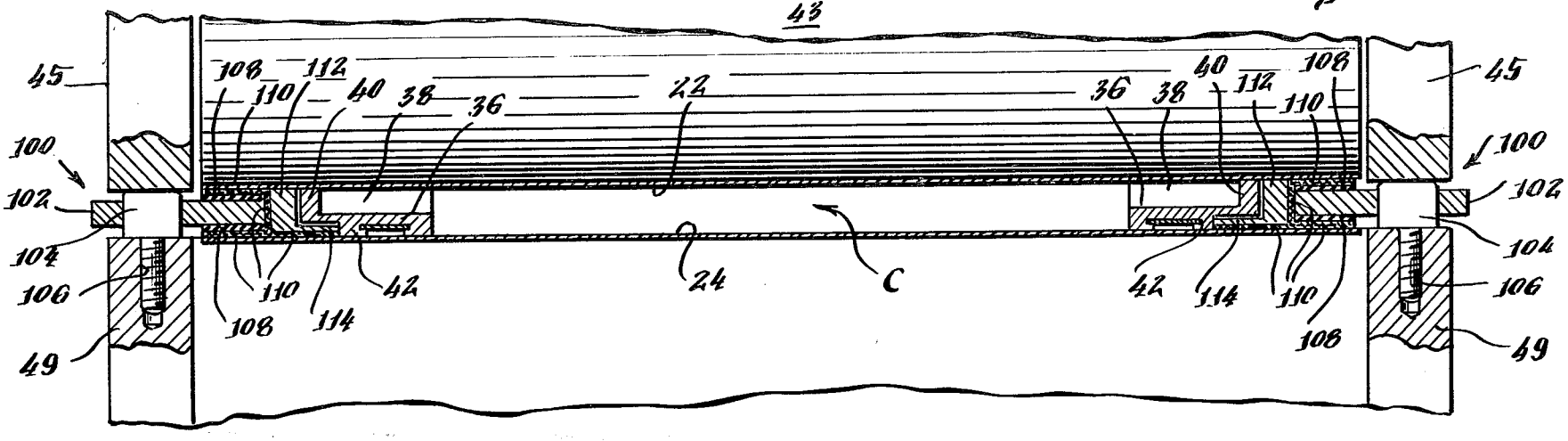
FIG. 10 is an enlarged cross-sectional view taken along the line 10—10 in FIG. 4 through the centerline of the upper nip pulley roll looking downstream and showing a water-seal and straight edge guide assembly for lateral guidance and alignment of the travelling edge dams of the first system.

Reference will now be made to FIG. 10 which shows damblock guidance and coolant seal apparatus 100 for guiding the travelling edge dams 30 of the first system embodiments along the opposite edges of the casting region C and for sealing against the entrance of liquid coolant into the casting region. FIG. 10 is an enlarged sectional view taken through the centerline of the upstream roll 43, which may also be called the "nip" roll. The location shown in FIG. 10 is the critical area for guidance and alignment of the damblocks, because the edge dams are entering the casting region along with the molten metal. The guidance and coolant seal apparatus 100 includes a rigid straight edge bar 102 which is held in place by a plurality of gauge spacers 104. These gauge spacers 104 have enlarged heads which accurately space the upper frame 45 away from the lower frame 49 thereby determining the spacing between the casting belts 22 and 24 and hence the height of the casting region C, and they have shanks which fit into sockets 106 in the lower frame 49.

Resilient pads 108, for example, of closed cell neoprene, are placed above and below the inner margin of the straight edge bar 102. Then a layer 110 of thermally insulating, high-temperature resistant and frictional-wear resistant material, for example, of woven asbestos, is wrapped in a horizontal U-shaped configuration around the inner edge of the bar 102. This thermal barrier and wear resistant layer 110 extends between the resilient pads 108 and the respective revolving casting belts 22 and 24. A guide member 112 having an L-shaped cross section is positioned with its straight-edged lower flange 114 extending inwardly at a low level for engaging the damblocks in guiding relationship. This lower flange 114 is positioned at a sufficiently low level to clear the cantilevered upper portions 40 of the special damblocks 36.

Thus, this flange 114 engages the lower portions 42 of the special damblocks as well as the regular damblocks for providing guidance to all of the damblocks passing by this guide. A thermal barrier and wear-resistant layer 110 is positioned below the flange 114 for supporting the L-shaped guide 112 away from contact with the lower casting belt. The upstanding flange of this guide 112 rests against the thermal barrier layer 110 covering the inner straight edge of the bar 102.

The resilient pads 108 press the thermal barrier and wear-resistant material 110 firmly against both the upper and lower casting belts 22 and 24, thereby preventing any liquid coolant from inadvertently entering into the casting region C. Any moistening of the material 110 becomes evaporated as a result of the hot environment near the casting region.

Figure 11:
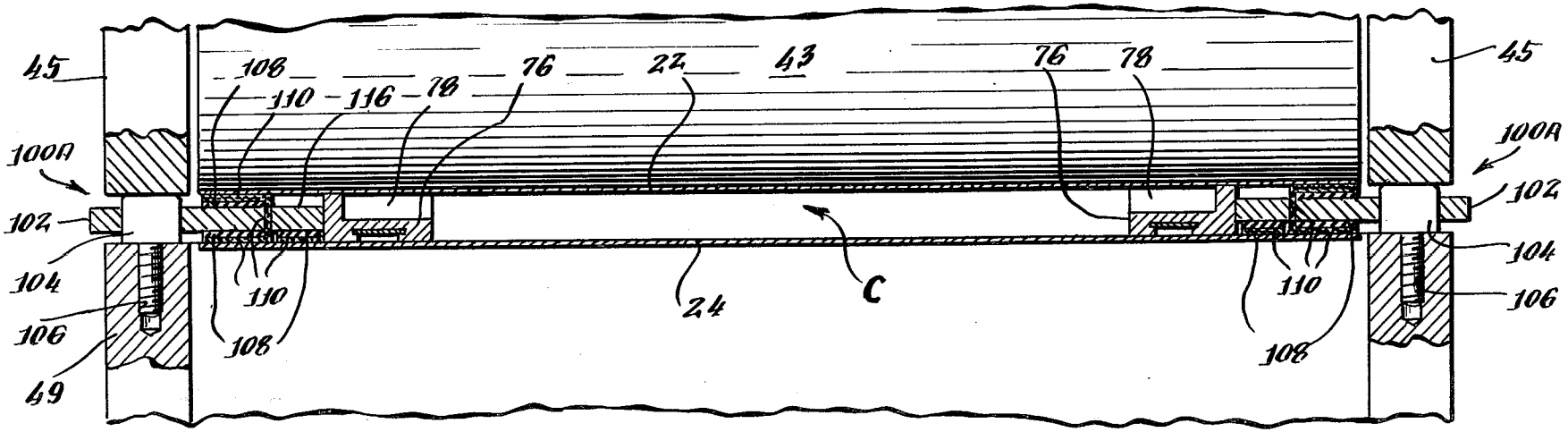
FIG. 11 is an enlarged cross-sectional view similar to FIG. 10 taken along the line 11—11 of FIG. 4 showing a water-seal and straight edge guide assembly for lateral guidance and alignment of the travelling edge dams of the second system.

Reference will now be made to FIG. 11 showing the guidance and coolant seal apparatus 100A for the travelling edge dams 30A of the second system embodiments. This apparatus 100A is generally similar to the apparatus 100 shown in FIG. 10, except that the L-shaped guide member 112 is replaced by a guide member 116 of rectangular cross section. A thermal barrier and wear-resistant layer 110 is positioned below the member 116. In addition, a resilient pad 108 is sandwiched between the bottom of the guide member 116 and the layer 110. The guide member 116 engages all of the damblocks passing by it, including the regular blocks 32 and the special blocks 76.

As shown in FIGS. 12, 13 and 14 electrode plates P, for example, such as copper anodes for electrolytic refining, are conveniently formed by severing the cast slab 52 along cut lines 55 as discussed above. The partial thickness lugs 54 are adapted to rest upon and to provide electrical connection with the side rails 120 of an electrolytic cell 121. A tank 122 contains the electrolyte 124 into which the electrode plates P are suspended. The lugs 54 project out generally horizontally beyond the side rails 120 where their free ends can be mechanically engaged by crane hooks or other lifting apparatus for conveniently lowering new electrode plates into the cell 121 and later for conveniently removing the upper portion of each consumed electrode plate. The upper portions of the spent electrodes are recycled by remelting and recasting with a slab 52.

In order to increase the proportionate amount of each electrode plate which is consumed, i.e. refined, and thereby to decrease the amount which is to be recycled, the cut line 55' (FIG. 12) along which each electrode is severed from its neighbor may have its central portion displaced downstream from the places 125 where the cut line intersects the edges of the cast slab. This displaced cut line curves gently downstream at a distance inward from each edge of the cast slab for providing shoulders 126 which have sufficient strength for anchoring the lugs 54 to the main body of the electrode P.

If desired for each of the electrode plates P to hang vertically, the lugs 54 are cast to have a thickness of at least one-half the thickness of the slab 52. Then the mold pockets 38 or 78 are undercut along their downstream (leading) wall so that the lowest portion of each lug 54 is predetermined to be located along a region 128 aligned with the central plane of the cast slab and hence aligned with the central plane 120 (FIG. 13) of each hanging plate. When the lug 54 is equal in thickness to one-half of the thickness of the plate, which is often the case, then the lowest region 128 occurs along the edge of the lug. By virtue of the fact that this region of support 128 is a line aligned with the central plane 130, i.e. with the center-of-gravity of the plate, each plate hangs vertically. As a result, there is very little variation in orientation of the hanging plates and they can be positioned in closely spaced relationship.

As shown in FIG. 13, the plates P are copper anodes which are hung closely spaced with cathode starter sheets 132 for electrolytic refining of the copper. The cathode starter sheets are suspended by a hanger bar (not shown) in a manner well known in the art. A portion of the side rail 120 is shown broken away in FIG. 13 for more clearly revealing the supporting edge 128 and the downwardly inclined lower surface 134 of each lug 54 resulting from undercutting of the leading wall of the mold pocket, as will be explained in greater detail further below.

Reference will now be made to FIGS. 15, 16 and 17 showing an edge dam 30 in accordance with the first system embodiments. All of the regular (standard) damblocks 32 have the same width W, and the lower portion 42 of each special damblock 36 has the same width. For example, W in one preferred embodiment as shown in FIGS. 15, 16 and 17 equals 3.0 inches. The endless flexible metal strap 34 has a width at least equal to one-half of W, but in the edge dam 30 of FIGS. 15, 16 and 17 this strap is wider than one-half W. As shown, the strap 34 has a width of 2.0 inches, namely, two-thirds of W. This relatively wide strap 34 runs through a T-shaped slot 136 in each and every damblock and is located closely spaced from the bottom surface of each block as seen clearly in FIGS. 16 and 17. As shown in FIG. 16, the strap 34 extends through the special damblocks below the mold pocket 38.

The partial depth mold pocket 38 is defined by a special damblock 36-1 immediately adjacent to another special damblock 36-2 downstream from first block 36-1. The damblock 36-1 containing the pocket 38 is somewhat longer in the upstream-downstream direction than all of the other damblocks which have the same upstream-downstream length L. For example, in this embodiment, the length L of all of the damblocks is 1.5 inches, while that of the special damblock 36-1 is 2.0 inches.

If desired, another special block 36-3 may be located upstream from the first block 36-1. The special block 36-3 may be omitted to be replaced by a regular damblock 32. Similarly, as indicated by the dash and dotted line 36-3 at the lower right in FIG. 15, a special damblock may be located downstream from the block 36-2. Whether or not any such additional special damblocks 36-3 are included depends upon the desired upstream-downstream extent of the cluster of special damblocks.

The pocket 38 has a flat bottom 138 in the block 36-1. The upstream wall 140 is shaped with a compound taper for reasons as will be explained further below. By the expression "compound taper", as used herein, is meant that this wall 140 slopes downstream toward the bottom 138 of the pocket and also slopes downstream toward the outer end wall 142 of the pocket. This outer end wall 142 is flat and is oriented parallel to the direction of travel of the edge dam 30.

If it is desired to provide an undercut in the downstream wall 144 of the mold pocket 38, this undercut may advantageously amount to approximately 4° to 6° as seen in FIG. 16. The undercut in the wall 144 is shown as formed by the adjacent surface of the downstream block 36-2.

If desired, the downstream wall of the pocket 38 may be formed without an undercut, i.e. may be flat as shwon in 144'.

In this embodiment, the partial depth mold pocket 38 has a depth approximately one-half of the overall height H of the damblocks. For example, the mold pocket, as shown has a depth of 0.875 of an inch while the height H of the damblock is 1.75 inches. The outer end wall 142 is spaced by a distance D of 4.13 inches from the inner side of the damblock 36-1 for casting a lug which projects out by this distance D from the edge of the cast slab.

At the mouth 145 of this mold pocket 38 where it opens out into the casting region, the upstream and downstream wall surfaces 140 and 144 (or 144') may be flared out by appropriate radii, as seen in FIG. 15, and the bottom surface 138 may also be flared out by an appropriate radius, as seen in FIG. 17. This flared out mouth configuration of the mold pocket provides the three curved fillets, as seen in FIG. 14 at 146, 148 and 149, for strengthening the connection between the lug 54 and the thicker main body of the casting. Corner radii may be provided as seen in FIGS. 16 and 17 where the bottom wall surface 138 meets the respective wall surfaces 140 and 142, and also where the latter meet.

The cantilevered upper portion 40 of the special damblocks 36-1, 36-2, 36-3 is spaced by a distance E from the bottom of the damblock. This distance E is always less than $\frac{3}{8}$ of the height H of the damblock in order to leave sufficient thickness of material at the cantilevered region 150 below the outer end of the mold pocket 38. In this example, as shown, the distance E is 2/7ths of the height H of the damblocks, such distance providing adequate clearance for the guide flange 114 (FIG. 10).

Reference will now be made to FIGS. 18, 19 and 17 in which the mold pocket 38 is generally similar to that shown in FIGS. 15, 16 and 17, except that it here is shown having its flat bottom 138 spanning across portions of two adjacent special blocks 36-4 and 36-5. By virtue of spanning two blocks, the pocket 38 may be made longer in the upstream-downstream direction (as seen by comparing FIG. 18 with FIG. 15) and yet each of the special damblocks 36-4 and 36-5 may have the same upstream-downstream length as the length L of the regular damblocks 32.

If desired, as indicated in FIG. 18, another special damblock 36-3 may be located upstream from the block 36-4 and/or downstream from the block 36-5. Such special block 36-3 may be omitted to be replaced by a regular damblock 32.

Reference will now be made to FIGS. 20, 21 and 17. The partial depth mold pocket 38 has a flat bottom 138 which spans across the full upstream-downstream length of the special damblock 36-6. Its downstream wall (which may be undercut as shown at 144 or flat as shown at 144') is defined by the adjacent surface of the downstream special damblock 36-2. Its upstream wall 140' is defined by the adjacent upstream special block 36-7. It is noted that this wall 140' is tapered or inclined only in the direction of the height of the block, but this wall extends transversely of the direction of travel.

As indicated in FIG. 20, by the dash and dotted lines 36-3, a special damblock may be positioned upstream from the block 36-7 and/or downstream from the block 36-2.

FIGS. 22, 23 and 24 show an edge dam 30A in accordance with the second system embodiments of the edge dams 30A. All of the regular damblocks 32 and special damblocks 76 have the same width W, which is shown as 4 inches in FIGS. 22 through 28. The strap 34 has a width of one-half of that amount and passes through T-shaped slots 136 in each of the blocks, being closely spaced from the bottom of each damblock as seen in FIGS. 23 and 24.

The partial depth mold pocket 78 is defined by a special damblock 76-1 adjacent to a downstream special damblock 76-2. The damblock 76-1 containing the pocket 78 is somewhat longer in the upstream-downstream direction than all of the other blocks which have the length L. For example, in this embodiment as shown, the length L is 1.5 inches and the length of the block 76-1 is 2.0 inches in the upstream-downstream direction. The pocket 78 has a flat bottom 158 in the block 76-1. The upstream wall 160 is shaped with a compound taper. The outer wall 162 ia flat and is oriented parallel with the direction of travel. The downstream wall 164 is undercut or, alternatively, as shown at 164' it may be flat. The mouth 145 of the mold pocket is shown flared out, as seen in FIG. 22, by appropriate radii at the inner regions of the walls 160 and 164 (or 164') and by a similar radius, as seen in FIG. 22, at the inner region of the bottom 158 for providing rounded fillets 146, 148 and 149 (FIG. 14).

In the embodiments of the second system edge dam 30A as shown in FIGS. 22–28, the overall height H of the damblocks is 1.5 inches, and the depth of the mold pocket 78 is one-half thereof, namely, 0.75 of an inch.

The mold pockets 78 extend transversely of the edge dam 30A by a distance D of 3.37 inches in FIGS. 22, 25 and 27 for casting lugs projecting by that amount from the main body of the casting. Their mouths 145 are flared out for reasons as described above.

In FIGS. 25, 26 and 24, the mold pocket 78 is generally similar to that in FIGS. 22, 23 and 24, except that it is here shown as having its flat bottom spanning across portions of two adjacent special damblocks 76-3 and 76-4. Thus, the pocket 78 in FIG. 25 is longer in the upstream-downstream direction than the pocket 78 in FIG. 22; however, by virtue of employing the two adjacent special blocks in this manner, they each may have the same length as that length L of the regular damblocks.

In FIGS. 27, 28 and 24, the mold pocket 78 has a flat bottom which extends across the full upstream-downstream length of the special damblock 76-5. Its downstream wall (which may be undercut as shown at 164 or flat as shown at 164') is defined by the adjacent surface of the downstream special block 76-2. Its upstream wall 160' is defined by the adjacent surface of the upstream special block 76-6, this surface 160' being tapered or inclined only in the direction of the height of the block.

In the various edge dams 30 and 30A shown in FIGS. 15–28, the various partial depth mold pockets 38 and 78 are defined by portions of at least two adjacent special damblocks. In certain illustrative embodiments as shown in FIGS. 20 and 21 and in FIGS. 27 and 28, the mold pockets were defined by portions of three adjacent special damblocks.

It is to be noted that the mold pocket 38 or 78 can be defined solely by one damblock, depending upon the length of this pocket in the upstream-downstream direction. The practical limit is that in most installations, it is undesirable for the length of such a special damblock to exceed 2.5 inches in length in the upstream-downstream direction.

It is to be noted that the downstream or leading wall 144 or 144', 164 or 164' of each partial depth mold pocket 38 or 78 may be considered as laterally shouldered sections of the respective edge dams for casting integral supporting shoulders at spaced positions along opposite edges of the cast slab as provided by the downstream or leading surface of the respective lugs 54.

The advantage of providing the upstream wall of the mold pocket with a compound taper will now be explained. As the molten metal is moving downstream in FIGS. 4, 5 and 6, it progressively solidifies from the exterior of the molten mass toward the interior thereof as heat is withdrawn. In other words, initially a shell of solid metal forms containing a molten core. This shell becomes progressively thicker as the product moves downstream from the casting region.

During this solidification, the slab 52 as it is being formed contracts both longitudinally, transversely, and in thickness. The compound taper of the mold wall 140 or 160 allows this shrinkage to occur without placing undue stress upon the newly forming upstream lugs. It will be understood that in each instance, the respective downstream lugs having solidified for a longer period of time, are stronger than those being newly formed upstream. By virtue of the compound taper shrinkage in one direction, whether transversely or in thickness, causes the freshly cast lug to retract slightly away from the mold wall 140 or 160 thereby providing clearance in the longitudinal direction for accommodating longitudinal contraction of the solidifying slab. Moreover, such a compound taper allows the cast lug 54 to be removed more readily from the partial depth mold pocket.

Figure 7:
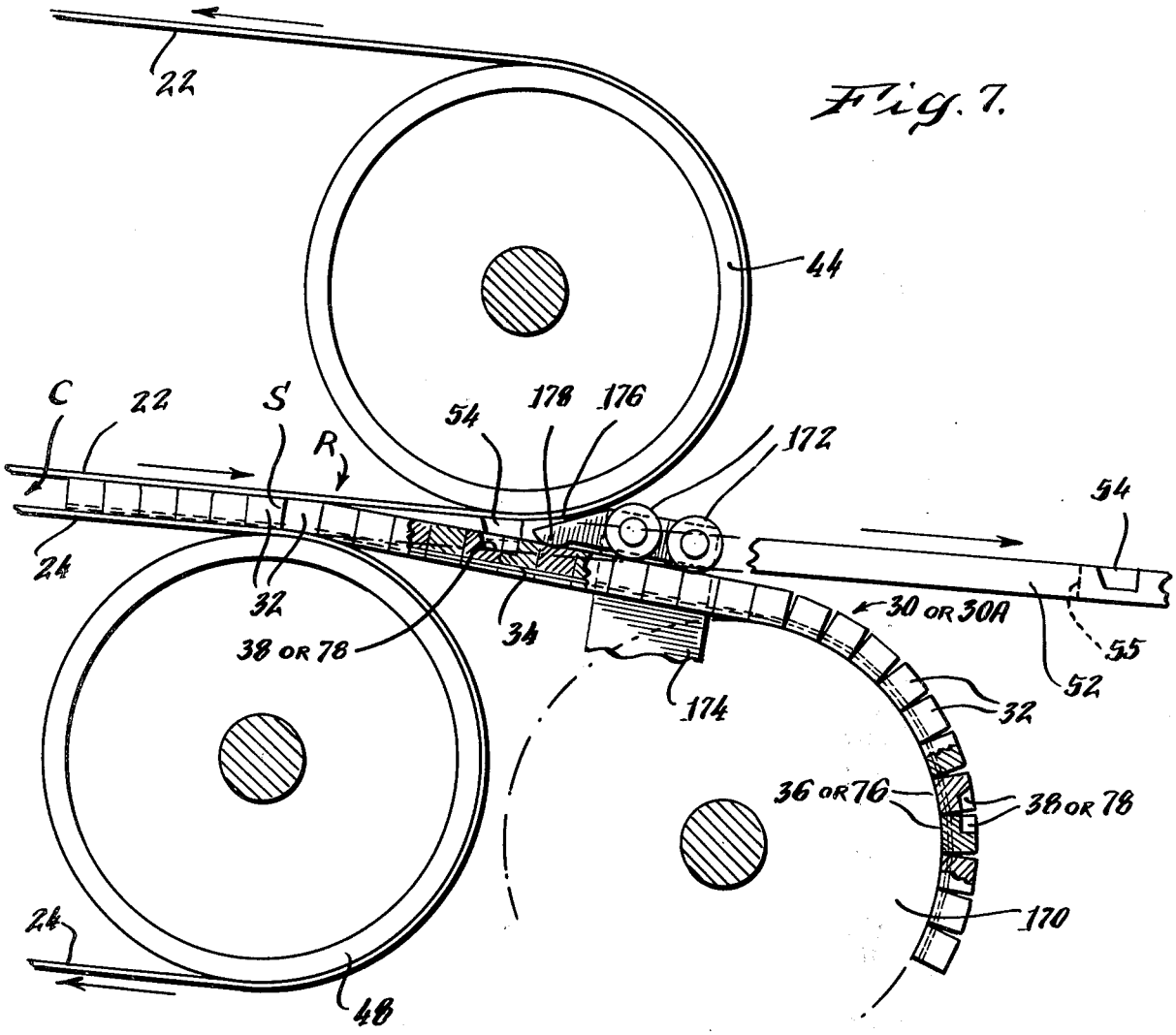
FIG. 7 is an enlarged elevational sectional view of the downstream end of the casting apparatus as seen in FIG. 4 showing the special damblocks defining the mold pocket being removed from the partial thickness cast lug.

In order to free the cast lugs from the partial depth mold pockets as shown in FIGS. 4 and 7, the travelling edge dams 30 and 30A are deflected downwardly so as to travel at an angle to the plane of the casting region C. As shown in FIG. 4, the deflected edge dam 30 or 30A may be passed over the guide rollers 62 and support 68. Alternatively, as shown in FIG. 7, the deflected edge dam 30 or 30A may be passed around a large flanged guide pulley 170 whose flanges are appropriately spaced to receive the width W of the respective edge dam, similar to the relationship betwen the roller flanges 64 (FIGS. 8 and 9) and the dimension W.

To aid in deflecting the edge dam 30 or 30A as it exits from the downstream end 56 of the casting region, there are a plurality of rollers 172 (FIG. 7) which are freely rotatably mounted on a frame member 174. These rollers 172 press down upon the upper surface of the travelling edge dam. In addition, there is a finger element 176 mounted on the frame member 174 having a rounded tip 178. This finger element extends upstream and engages the top surface of the damblocks near the exit of the casting region. Thus, as shown in FIG. 7, the travelling edge dam 30 or 30A is stripped away from the successive lugs 54.

By virtue of the fact that the strap 34 is located near the bottom of the travelling edge dam 30 or 30A, the damblocks momentarily fan or spread apart toward their upper tops with wedge-shaped spaces S (FIG. 7) occurring between them in the localized region R where the travelling edge dam changes direction. This brief fan-out or spreading at R opens up the top of each partial depth mold pocket in succession, thereby helping to release the respective lug 54 therefrom.

Although it is preferable to have the travelling edge dams 30 or 30A travelling around the lower belt 24, as shown in FIG. 4, it is also possible to invert these edge dams, as shown in FIG. 29. That is, the travelling edge dams 30 or 30A can be caused to revolve around the upper casting belt 22. In order to accomplish this inverted arrangement, there is provided a curved support 180 having a plurality of the freely rotatable flanged guide rollers 62 mounted thereon. The rollers 62 on this support 180 carry the respective travelling edge dams along the major portion of their return path. At the upstream and downstream ends of the casting region, there are arcuate supports 182 with similar rollers 62 mounted thereon. The "back breaker" guide means 70' is similar in function to the guide means 70, as shown in FIG. 4. The curved support 180 is pivotally mounted at a pivot 186 and is urged upwardly by spring means 188 which may be mechanical or pneumatic. The purpose of this spring means 188 is to apply tension to the edge dams 30 or 30A, similar to the effect of gravity in FIG. 4 as it is acting on the downwardly hanging portions of the edge dams.

As a result of the inverted arrangement of the travelling edge dams 30 or 30A, the partial depth mold pockets are located in the lower portions of the special damblocks. Thus, the cast lugs 54 are formed adjacent to the lower surface of the slab 52, as shown in FIG. 29.

Accordingly, in interpreting the following claims, it is to be understood that the physical relationship of the various parts of the edge dams can be inverted, as shown in FIG. 29. Thus, the words "upper" and "top" should be interpreted to cover the equivalent words "lower" and "bottom" and vice versa. In view of the fact that the arrangement, as shown in FIG. 4, is the preferred embodiment, in which the edge dams may be deemed to be right side up, the claims are written with the preferred orientation in mind but are not intended to be limited to their preferred orientation.

It is to be understood that the apparatus as shown in FIG. 29 is provided with sensing means 92 or 92' or 92'' together with the controller 94 and controllable cooling apparatus 80 for maintaining synchronized travel of the respective edge dams. This apparatus is omitted from FIG. 29 for clarity of illustration.

If desired, the controller 94 may include a control panel with readable indicator means (not shown) for indicating to the operator when the one edge dam is lagging or leading the other and by how much. This indicator means may include a group of lights which become illuminated in sequence to show the relative deviation of the travel of one edge dam with respect to the other or a numerical read out display for showing such relative deviation and its amount. Also, the fluid flow control means 90 may include a manually operable valve for controlling the amount of cooling being applied to the travelling edge dam.

Thus, the synchronization of the travel of the two edge dams may be accomplished by an operator who visually monitors the control panel and manually adjusts the temperature control 90 from time-to-time during the casting operation to overcome any tendency for one edge dam to lag or lead the other. This manual adjustment valve in the temperature controller 90 may be arranged as standby equipment to supplement or override the automatic control action if the occasion should arise. The preferred mode of manually operating such control 90 is a method similar to that as discussed above for automatic synchronization. Namely, one of the edge dams is preselected as the reference, and the other is preselected as the one to be controlled. The human operator then adjusts the control 90 in a manner to keep the controlled edge dam travelling closely in synchronization with the travel of the reference edge dam.

We claim:

1. The method of continuously casting a metal slab comprising the steps of providing a casting region with an endless revolving casting belt for supporting the molten metal and a pair of laterally spaced endless revolving edge dams travelling along either edge of the casting region and with the casting belt at substantially the same speed as the belt, providing in said edge dams partial depth mold pockets communicating with the casting region and having a depth less than the depth of the casting region, introducing molten metal into the casting region and cooling the molten metal in the casting region to form a continuously cast slab having integral partial thickness lugs extending from opposite edges thereof.

2. The method of continuously casting a metal slab as claimed in claim 1, including providing each of said edge dams with a uniform width throughout the major portion of the length thereof, except extending said partial depth mold pockets laterally away from the center of the casting region by a distance greater than said uniform width of the respective edge dam.

3. The method of continuously casting a metal slab as claimed in claim 1, including providing each of said edge dams with a multiplicity of damblocks of uniform width along the lower portion thereof, extending said partial depth mold pockets in each edge dam laterally outwardly from the centerline of the casting region by a distance greater than said uniform width by providing damblocks having upper portions projecting outwardly in cantilevered relationship with respect to their lower portions and having such partial depth mold pockets formed in their upper portions, and guiding the edge dams by engaging said lower uniform widgh portions of said damblocks.

4. The method of continuously casting a metal slab as claimed in claim 3, including providing an endless flexible metal strap for each of the edge dams and having a width greater than one-half said uniform width, and passing said strap through slots in the lower portions of all of the damblocks in the edge dam including those having cantilevered upper portions with partial depth mold pockets therein.

5. The method of continuously casting a metal slab as claimed in claim 1, including the steps of providing partial depth mold pockets having a depth equal approximately to one-half of the thickness of said casting region, providing a leading wall of each such mold pocket which is undercut for casting a slab having integral partial thickness lugs which are approximately one-half the thickness of the cast slab and wherein the portion of each such lug which projects forwardmost in the direction of travel of the slab coincides approximately with the medial plane of said cast slab, and cutting the slab into separate anodes along cutting lines extending across the slab near to the respective pairs of lugs on opposite edges of the slab, said cutting lines being behind the lugs in the direction of travel of the slab, thereby providing anodes which hang approximately vertically when the respective pairs of lugs are resting on horizontal supporting side rails with such forwardmost portions of each such lug engaging upon the horizontal side rails.

6. The method of continuously casting a metal slab comprising the steps of providing a casting region with an endless revolving casting belt for supporting the molten metal and a pair of laterally spaced endless revolving edge dams travelling along either edge of the casting region and with the casting belt at substantially the same speed as the belt, providing in said edge dams partial depth mold pockets communicating with the casting region and having a depth less than the depth of the casting region, introducing molten metal into the casting region, cooling the molten metal in the casting region to form a cast slab having integral partial thickness lugs extending from opposite edges thereof, and wherein the endless revolving edge dams travel from the downstream end to the upstream end of the casting region along a return path which is located away from the casting region and wherein the edge dams are controllably cooled as they travel along said path, and including the steps of sensing the relative longitudinal positions of the parallel depth mold pockets in the respective edge dams travelling along opposite edges of the casting region, and relatively changing the cooling being applied to one of the edge dams whenever it commences to become misaligned with the other edge dam by relatively increasing the cooling for decreasing the length of such edge dam when it tends to lag the other edge dam, thereby relatively increasing the rate of travel of the lagging edge dam for relatively longitudinally advancing its partial depth mold pockets to bring them into alignment with the partial depth mold pockets in the other edge dam and vice versa when it tends to lead the other edge dam, whereby the metal slab is continuously cast with the respective integral partial thickness lugs maintained in alignment on opposite edges of the cast slab.

7. The method of continuously casting a metal slab by providing a casting region having an endless revolving casting belt for supporting the molten metal with a pair of laterally spaced endless revolving edge dams each formed by a multiplicity of damblocks strung on an endless flexible metal strap, and said edge dams travelling along either edge of the casting region at substantially the same speed as the belt comprising the steps of providing special damblocks in said edge dams at spaced positions therealong defining partial depth mold pockets having a depth less than the height of said special damblocks, positioning said endless flexible metal strap midway between the outer and inner sides of each edge dam and passing said endless strap through said special damblocks directly below the partial depth mold pocket for holding the damblocks of each edge dam snuggly together, introducing molten metal into the casting region and flowing into said partial depth mold pockets, and cooling the molten metal in the casting region fo forming a continuously cast slab having integral partial thickness lugs extending from opposite edges thereof.

8. The method of continuously casting a metal slab as claimed in claim 7, in which said partial depth mold pockets have a depth of approximately 50% of the overall height of the edge dams.

9. In the casting of molten metal into a slab in a twin-belt metal casting machine wherein two edge dams each revolve in a loop travelling along opposite edges of a casting region from its input end to its output end between a pair of revolving casting belts to define a moving mold and wherein each edge dam has laterally shouldered sections at positions spaced longitudinally along the respective edge dam for casting integral supporting shoulders on opposite edges of the cast slab and wherein the loop of each travelling edge dam returns from the output end to the input end of the casting region along a return path which is located away from the casting region, the improved method of maintaining synchronization of the travelling of the two edge dams for maintaining a predetermined relationship between the integral supporting shoulders being cast on opposite edges of the cast slab comprising the steps of sensing the relative positions of the laterally shouldered sections of the respective edge dams as they are each revolving, cooling each edge dam in its return path, and relatively changing the temperature of one revolving edge dam with respect to the other over at least a portion of its length when the one tends to lag behind or to lead the other relatively decreasing the length of such lagging edge dam thereby relatively increasing its rate of revolving with respect to the other for overcoming the lagging tendency or for relatively increasing the length of such leading edge dam thereby relatively decreasing its rate of revolving with respect to the other for overcoming the leading tendency for maintaining th travelling of two edge dams in synchronization.

10. In the casting of molten metal, the improved method of maintaining synchronization of the travelling of the two edge dams as claimed in claim 9, in which the sensing of the relative positions of the laterally shouldered sections of the respective edge dams as they are each revolving is accomplished by sensing the relative positions of the integral supporting shoulders formed on opposite edges of the cast slab after the cast slab has issued from the casting region.

11. In the casting of molten metal, the improved method of maintaining synchronization of the travelling of the two edge dams as claimed in claim 9, in which the sensing of the relative positions of the laterally shouldered sections of the respective edge dams as they are each revolving is accomplished by sensing the relative positions of the one edge dam with respect to the other.

12. In the casting of molten metal, the improved method of maintaining synchronization of the travelling of the two edge dams as claimed in claim 9, in which relatively changing the temperature of one revolving edge dam with respect to the other over at least a portion of its length is accomplished by changing the cooling being applied thereto in its return path.

13. In the continuous casting of a metal slab wherein a casting region is formed between a pair of endless revolving casting belts having portions travelling in spaced relationship along opposite sides of the casting region and a pair of laterally spaced endless revolving edge dams travel between the belts along either edge of the casting region and move with the casting belts at substantially the same speed as the belts, the improved method of casting integral lugs at spaced positions along opposite edges of the cast slab comprising the steps of forming each of said edge dams by a multiplicity of damblocks each of the same uniform width at least along a first surface thereof, forming a groove extending longitudinally along all of the respective damblocks in each edge dam in said first surface thereof, forming partial depth mold pockets in predetermined damblocks at spaced positions in a second surface of each of said edge dams for communicating with the casting region as the respective edge dam travels along the edge of the casting region, said second surface of the edge dam being opposite to said first surface, providing an endless flexible strap extending longitudinally along each of the edge dams through said groove in each of the damblocks thereof including the predetermined damblocks having partial depth mold pockets therein for holding all of said damblocks snuggly together, and introducing molten metal into the casting region for forming a continuously cast slab having integral partial thickness lugs extending from opposite edges thereof.

14. The improved method of casting integral lugs along opposite edges of a continuously cast slab as claimed in claim 13, including the steps of providing said predetermined damblocks with cantilevered portions adjacent said second surface projecting outwardly beyond said uniform width, and extending said partial depth mold pockets outwardly into said cantilevered portions for forming a cast slab having integral partial thickness lugs extending from opposite edges thereof a greater distance than said uniform width.

15. In the continuous casting of a metal slab wherein a casting region is formed between a pair of endless revolving casting belts having portions travelling in spaced relationship along opposite sides of the casting region and a pair of laterally spaced endless revolving edge dams travel between the belts along either edge of the casting region and move with the casting belts at substantially the same speed as the belts, the improved method of casting integral lugs at spaced positions along opposite edges of the cast slab comprising the steps of forming each of said edge dams by a multiplicity of damblocks each of the same uniform width at least along a first surface thereof, forming a groove extending longitudinally along all of the respective damblcoks in each edge dam in said first surface thereof, forming partial depth mold pockets in predetermined damblocks at spaced positions in a second surface of each of said edge dams for communicating with the casting region as the respective edge dam travels along the edge of the casting region, said second surface of the edge dam being opposite to said first surface, providing an endless flexible strap extending longitudinally along each of the edge dams through said groove in each of the damblocks thereof including the predetermined damblocks having partial depth mold pockets therein for holding all of said damblocks snuggly together, introducing molten metal into the casting region for forming a cast slab having integral partial thickness lugs extending from opposite edges thereof, and sensing the relative longitudinal positions of the mold pockets in the respective edge dams as they are revolving for determining whichever of the edge dams might be tending to lag behind the other, and reducing the relative temperature of the lagging edge dam relative to the other over at least a portion of its revolution for decreasing the length of the lagging edge dam relative to the other, thereby increasing the relative rate of its revolution for synchronizing the movement of its mold pockets with respect to the other.

16. The improved method of casting integral lugs along opposite of a cast slab as claimed in claim 15, including the steps of making the cumulative length of the damblocks in each edge dam very nearly the same, making the length of the endless flexible strap in each edge dam very nearly the same, and making the accumulated length of the damblocks between each successive partial depth mold pocket in each edge dam very nearly the same.

17. The improved method of casting integral lugs along opposite edges of a cast slab as claimed in claim 16, in which said cast slab is copper adapted to be cut into electrode plates, including the steps of forming the strap in each edge dam of stainless steel and forming the damblocks of bronze having a coefficient of thermal expansion very similar to that of the strap.

18. In the casting of molten metal into a slab in a twin-belt metal casting machine wherein two revolving casting belts define a casting region therebetween and two edge dams each revolve along laterally spaced paths and over a portion of each path they travel along opposite edges of the casting region and wherein each edge dam has laterally shouldered sections at predetermined longitudinally spaced positions therein for casting integral shoulders at spaced positions along opposite edges of the cast slab, the improved method of synchronizing the travel of the laterally shouldered sections of the respective edge dams along the opposite edges of the casting region comprising the steps of sensing the travel of the shouldered sections of one edge dam relative to the other for determining whenever the one edge dam is tending to lag behind the other, and relatively decreasing the temperature of the one with respect to the other over at least a portion of the travel of the one for relatively decreasing its length with respect to the other to speed up its relative rate of revolving for overcoming its tendency to lag behind the other.

19. In the casting of molten metal, the improved method of maintaining synchronization of the travel of the laterally shouldered sections of the respective edge dams as claimed in claim 18, including the steps of sensing the travel of the shouldered sections of one edge dam relative to the other for determining whenever the one is tending to lead ahead of the other, and relatively increasing the temperature of the one with respect to the other over at least a portion of the travel of the one for relatively increasing its length with respect to the other to slow down its relative rate of revolving for overcoming its tendency to lead ahead of the other.

20. Apparatus for continuously casting a metal slab comprising at least one endless revolving flexible casting belt for supporting the molten metal in a casting region and a pair of laterally spaced endless revolving edge dams travelling along at substantially the same speed as the belt for defining opposite edges of the casting region, each of said edge dams having a predetermined height, and each of said edge dams having a plurality of partial depth mold pockets therein at spaced positions along the edge dam, said mold pockets communicating with the molten metal in the casting region and having a depth less than the predetermined height of the edge dam for continuously casting a metal slab having integral partial thickness lugs extending from opposite edges thereof.

21. Apparatus for continuously casting a metal slab as claimed in claim 20, in which said partial depth mold pockets have a depth of approximately 50% of the height of the edge dam.

22. Apparatus for continuously casting a metal slab as claimed in claim 21, in which a leading wall of each mold pocket in the direction of travel of the edge dam is undercut for casting integral partial thickness lugs in which the forwardmost portion of each lug in the direction of travel is located approximately midway of thickness of the cast slab.

23. Apparatus for continuously casting a metal slab as claimed in claim 20, in which at least one of said edge dams has a predetermined width, guide means engaging said one edge dam along the lower portion thereof for guiding the edge dam along the edge of the casting region, said one edge dam having near each of said partial depth mold pockets a cantilevered upper portion projecting outwardly in a direction away from the casting region, said cantilevered upper portions being spaced sufficiently far above the bottom of the edge dam for clearing said guide means, and said partial depth mold pockets extending outwardly into the respective cantilevered upper portions of the edge dam to width wider than said predetermined width of the edge dam.

24. Apparatus for continuously casting a metal slab as claimed in claim 23, in which said cantilevered upper portions of said edge dam are spaced above the bottom of the edge dam by a distance E of at least 2/7ths of said predetermined height of the edge dam.

25. Apparatus for continuously casting a metal slab as claimed in claim 23, in which at least said one edge dam includes a multiplicity of damblocks strung onto an endless flexible metal strap extending through a slot in the lower portion of each of said damblocks, said cantilevered upper portions of said one edge dam being provided by special damblocks having such cantilevered portions, and said strap passing through a slot in the lower portion of said special damblocks beneath said partial depth mold pockets.

26. Apparatus for continuously casting a metal slab as claimed in claim 25, in which said strap has a width of two-thirds of said predetermined width of the edge dam.

27. Apparatus for continuously casting a metal slab as claimed in claim 20, in which the trailing wall surface of each of said partial depth mold pockets has a dual slope, said trailing wall sloping forwardly from the top toward the bottom of the partial depth mold pocket and also sloping forwardly in the outward direction away from the casting region for accommodating longitudinal shrinkage of the cast slab while accommodating the newly formed cast lugs projecting from the cast slab.

28. Apparatus for continuously casting a metal slab as claimed in claim 23, in which a plurality of flanged guide rollers engage said one edge dam along the lower portion thereof in rolling contact therewith for guiding the travelling edge dam toward the casting region, said guide rollers having flanges spaced apart sufficiently far for straddling the predetermined width of the edge dam for laterally guiding the travelling edge dam, and said cantilevered upper portions of the edge dam being spaced sufficiently far above the bottom of the edge dam for clearing the flanges of said guide rollers.

29. Apparatus for continuously casting a metal slab as claimed in claim 20, in which at least one edge dam includes a multiplicity of damblocks strung onto an endless flexible metal strap extending through a slot in the lower portion of each of said damblocks, said partial depth mold pockets in said one edge dam being defined by special damblocks, and said strap passing through a slot in the lower portion of said special damblocks beneath said partial depth mold pockets.

30. Apparatus for continuously casting a metal slab as claimed in claim 29, in which said one edge dam has a predetermined width, said endless flexible metal strap having a width at least equal to one-half of said predetermined width, and said strap extending along said one edge dam midway between the outside and inside thereof for holding said damblocks sunggly together along the outside and inside of said edge dam.

31. Apparatus for continuously casting a metal slab as claimed in claim 20, in which said partial depth mold pockets each includes a leading wall surface, a bottom wall surface and a trailing wall surface, said three wall surfaces defining an open mouth facing toward the casting region through which the molten metal enters the partial depth mold pockets, and said three wall surfaces flaring outwardly toward the casting region for casting a partial thickness lug on the edge of the cast slab having three rounded fillets on the leading, bottom and trailing regions where the lug is integrally joined to the cast slab.

32. In a machine for continuously casting a metal slab wherein at least one endless revolving flexible casting belt supports the molten metal in a casting region and a pair of laterally spaced endless revolving edge dams travelling along at substantially the same speed as the belt define opposite edges of the casting region, said edge dams defining mold cavities for intergrally casting projecting lugs on opposite edges of the cast slab, apparatus for controlling the relative travelling of the two edge dams along opposite edges of the casting region comprising sensing means for sensing the relative positions of the mold cavities in one of the travelling edge dams relative to the other edge dam, said edge dams having a positive temperature coefficient of thermal expansion, means for changing the relative temperature of one of the edge dams with respect to the other over at least a portion of its revolving path, and control means for controlling said temperature changing means for thermally slightly changing the length of one of said edge dams relative to the other for slightly changing the rate of revolving of one relative to the other when the one tends to deviate from the desired rate of travel with respect to the other.

33. In a machine for continuously casting a metal slab, apparatus for controlling the relative travelling of the two edge dams along opposite edges of the casting region as claimed in claim 32, in which said sensing means senses the relative positions of the projecting lugs on opposite edges of the cast slab for sensing the relative positions of the mold cavities.

34. In a machine for continuously casting a metal slab, apparatus for controlling the relative travelling of the two edge dams along opposite edges of the casting region as claimed in claim 32, in which said two edge dams have very nearly the same length at room temperature and the distance between successive mold cavities in each of the travelling edge dams is very nearly the same.

35. In a machine for continuously casting a metal slab, apparatus for controlling the relative travelling of the two edge dams along opposite edges of the casting region as claimed in claim 32, in which said means for changing the relative temperature of one of the edge dams with respect to the other includes cooling means applying cooling fluid to the edge dams, and said control means includes means for changing the flow of cooling fluid being applied to at least one of the edge dams.

36. In a machine for continuously casting a metal slab, apparatus for controlling the relative travelling of the two edge dams along opposite edges of the casting region as claimed in claim 32, in which said edge dams include outwardly projecting cantilevered portions defining said mold cavities as partial depth mold pockets in said edge dams having a width greater than the width of the remainder of each edge dam, and said sensing means for sensing the relative positions of the mold cavities in one of the travelling edge dams relative to the other are actuated by said projecting cantilevered portions of said edge dams.

37. In a machine for continuously casting a copper slab including at least one endless flexible casting belt for supporting the copper being cast in a casting region and a pair of laterally spaced endless revolving edge dams travelling along at substantially the same speed as the belt for defining opposite edges of the casting region, said edge dams each including a multiplicity of damblocks with an endless flexible metal strap passing therethrough and said edge dams each having mold cavities therein at spaced positions therealong for casting lugs at spaced positions along opposite edges of the cast copper slab, whereby said copper slab can be cut to form electrodes, apparatus for contolling the relative travelling of the two edge dams comprising, said damblocks being formed of bronze, said endless flexible metal strap being stainless steel having a temperature coefficient of thermal expansion very similar to said bronze damblocks, said two edge dams having very nearly the same length at room temperature and the distance between successive mold cavities along each edge dam being very nearly the same, means for sensing the relative positions of the mold cavities in one of the travelling edge dams relative to the other edge dam, means for changing the relative temperature of one of the edge dams with respect to the other at least a portion of its revolving path, and control means for controlling said temperature changing means for thermally slightly changing the length of one of said edge dams relative to the other for slightly changing the rate of revolving of one relative to the other when the one tends to deviate from the desired path of travel with respect to the other.

38. For use in apparatus for continuously casting a metal slab wherein at least one endless revolving flexible casting belt defines a surface of a casting region and a pair of laterally spaced endless revolving edge dams travelling along at substantially the same speed as the belt for defining opposite edges of the casting region, a travelling edge dam for integrally casting projecting lugs on opposite edges of the cast slab comprising: a multiplicity of damblocks of predetermined width, said multiplicity of damblocks including a plurality of special damblocks defining partial depth mold pockets in the upper portion of each edge dam, and an endless flexible strap passing through an opening in the lower portion of each damblock on which said damblocks are strung, said special damblocks having said strap passing therethrough below the partial depth mold pockets defined thereby, whereby the projecting lugs being integrally cast on said slab have a thickness less than the thickness of the cast slab.

39. A travelling edge dam as claimed in claim 38, in which said flexible strap has a width at least equal to half of said predetermined width of said edge dam, and said strap is located midway between the inside and outside of said edge dam for holding said damblocks snuggly together along their inside and outside.

40. A travelling edge dam as claimed in claim 38, in which said partial depth mold pockets have a depth equal to approximately one-half of the height of said special damblocks.

41. A travelling edge dam as claimed in claim 40, in which the leading walls of the partial depth mold pockets in the direction of travel of the respective edge dam are undercut for casting said lugs having their leading edges located in alignment with the medial plane of the cast slab.

42. A travelling edge dam as claimed in claim 38, in which said special damblocks include cantilevered upper portions extending outwardly beyond said predetermined width, said partial depth mold pockets extending outwardly in said cantilevered upper portions to a distance greater than said predetermined width.

43. A travelling edge dam as claimed in claim 42, in which said special damblocks having said cantilevered upper portions include lower portions having the same predetermined width as the remaining damblocks, and said flexible strap has a width approximately equal to two-thirds of said predetermined width.

44. A travelling edge dam as claimed in claim 42, in which said cantilevered upper portions are spaced above the bottom of the special damblocks by an amount E equal at least to two-sevenths of the height of said special damblocks.

* * * * *